US010166670B2

(12) United States Patent
Larsson

(10) Patent No.: US 10,166,670 B2
(45) Date of Patent: Jan. 1, 2019

(54) TOOL BIT HOLDER

(71) Applicant: Luna Verktyg & Maskin AB, Alingsas (SE)

(72) Inventor: Dan Larsson, Alingsas (SE)

(73) Assignee: Luna Verktyg & Maskin AB, Alingsas (SE)

( * ) Notice: Subject to any disclaimer, the term of this patent is extended or adjusted under 35 U.S.C. 154(b) by 0 days.

(21) Appl. No.: 15/768,102

(22) PCT Filed: Oct. 16, 2015

(86) PCT No.: PCT/SE2015/051106
§ 371 (c)(1),
(2) Date: Apr. 13, 2018

(87) PCT Pub. No.: WO2017/065662
PCT Pub. Date: Apr. 20, 2017

(65) Prior Publication Data
US 2018/0311810 A1 Nov. 1, 2018

(51) Int. Cl.
*A47F 7/00* (2006.01)
*B25H 3/00* (2006.01)
*A45F 5/02* (2006.01)

(52) U.S. Cl.
CPC ..... *B25H 3/003* (2013.01); *A45F 5/021* (2013.01); *A45F 2200/0575* (2013.01)

(58) Field of Classification Search
CPC ..... A47F 7/00; B65D 85/28; B65D 85/20
(Continued)

(56) References Cited

U.S. PATENT DOCUMENTS 4,880,122 A * 11/1989 Martindell ..... B25H 3/003 211/70.6
5,775,499 A * 7/1998 Budert ..... B65D 85/20 206/349

(Continued)

FOREIGN PATENT DOCUMENTS

JP H08290375 A 11/1996
JP 2015096283 A 5/2015
TW M245030 U 10/2004

OTHER PUBLICATIONS

International Searching Authority (ISA), International Search Report and Written Opinion for International Application No. PCT/SE2015/051106, 14 pages, dated Jun. 20, 2016, 14 pages, Swedish Patent and Registration Office, Sweden.

(Continued)

*Primary Examiner* — Brian D Nash
(74) *Attorney, Agent, or Firm* — Alston & Bird LLP

(57) ABSTRACT

The invention relates to a tool bit holder (10), for holding tool bits for a hand tool. The tool bit holder (10) has an extension along an x-axis, along a y-axis being perpendicular to the x-axis, and along a z-axis being perpendicular to the x-axis and y-axis. The tool bit holder (10) comprises an at least partially arc-shaped main surface (12), where the arc-shaped part (13) of the main surface (12) at least partially transitions between the y-axis to the z-axis. The main surface (12) is provided with an elongated slit (11) extending at least along its arc-shaped part (13) essentially along the x- and y-axis. The slit (11) is provided with an inner and an outer section (17), where the outer section (17) is level with the main surface (12) and the inner section (16) is wider than the outer section (17). The outer section (17) is adapted to receive the waist (3) of a tool bit (1) according the standard ISO 1173:2001, Form E.

14 Claims, 19 Drawing Sheets

(58) Field of Classification Search
USPC ..... 224/183; 206/372–377
See application file for complete search history.

(56) References Cited

U.S. PATENT DOCUMENTS

| | | | | |
|---|---|---|---|---|
| 6,050,409 | A * | 4/2000 | Delbeck | B25H 3/003 206/375 |
| 6,571,966 | B1 * | 6/2003 | Hsiao | A47F 7/0028 206/379 |
| 6,615,983 | B1 * | 9/2003 | Yu | B25H 3/003 206/372 |
| D515,897 | S * | 2/2006 | Greene | D8/71 |
| 7,168,559 | B2 * | 1/2007 | Chen | B25H 3/003 206/373 |
| 7,780,016 | B1 * | 8/2010 | Cornwell | B25H 3/003 211/69 |
| 7,896,158 | B2 * | 3/2011 | Taylor | B25H 3/003 206/372 |
| D646,304 | S * | 10/2011 | Pickett | D15/28 |
| 8,069,984 | B2 * | 12/2011 | Larson | B25H 3/023 206/372 |
| 8,196,742 | B1 | 6/2012 | Wang | |
| 8,646,602 | B2 * | 2/2014 | Wang | B25H 3/003 206/372 |
| 9,144,306 | B2 * | 9/2015 | Kao | A47B 81/00 |
| 9,186,789 | B2 * | 11/2015 | Wang | B65D 25/10 |
| 9,937,614 | B2 * | 4/2018 | Meyers | B25H 3/006 |
| 2010/0122926 | A1 | 5/2010 | Tocco et al. | |

OTHER PUBLICATIONS

International Preliminary Examining Authority, International Preliminary Report on Patentability, including Applicant's Jul. 25, 2017 response to ISA's Jun. 20, 2016 Written Opinion, for International Application No. PCT/SE2015/051106, dated Oct. 23, 2017, 14 pages, European Patent Office, Netherlands.

* cited by examiner

TOOL BIT HOLDER

CROSS REFERENCE TO RELATED APPLICATIONS

This application is a National Stage Application, filed under 35 U.S.C. 371, of International Application No. PCT/SE2015/051106, filed Oct. 16, 2015, the contents of which are hereby incorporated by reference in their entirety.

BACKGROUND

Related Field

The invention relates to a tool bit holder for holding tool bits for a hand tool.

Description of Related Art

Bits such as drive bits and drill bits are commonly used tools for assembly and disassembly and are for instance used at construction sites, in mechanical workshops or at home for renovation or remodelling.

The bits usually come in boxes carrying an assortment of different types of for example screwdriver bits, socket bits or drill bits. The person using the bits may need several types of bits in order to carry out all necessary tasks during a day. Tasks may include using screw drives of various types, drilling or sawing using a hole saw. It may be difficult for the person using the bits to keep all necessary bits close at hand as the person may operate in small spaces and move over large distances during the day.

BRIEF SUMMARY

There is thus a need for an improved tool bit holder addressing the problems mentioned above.

The object of the present invention is to provide an inventive tool bit holder where the problems of prior art holders are at least partly avoided. The tool bit holder is characterized by the features in the characterizing portion of claim 1. Another object of the invention is to provide a holder arrangement comprising a tool bit holder and a belt clip. The arrangement is characterized by the features of claim 14.

The invention relates to a tool bit holder for holding tool bits for a hand tool such as drive bits and/or drill bits. The tool bit holder has an extension along an x-axis, along a y-axis being perpendicular to the x-axis, and along a z-axis being perpendicular to the x-axis and y-axis. The tool bit holder comprises an at least partially arc-shaped main surface, where the arc-shaped part of the main surface at least partially transitions between the y-axis and the z-axis. The main surface is provided with an elongated slit extending at least along the arc-shaped part essentially along the x- and y-axis. The slit is provided with an inner and an outer section, where the outer section is level with the main surface and the inner section is wider than the outer section. The outer section is adapted to receive the waist of a tool bit according the standard ISO 1173:2001, Form E.

With a hand tool is meant a tool having a socket arranged to receive the bit. Examples of hand tools are a wrench or similar or a powered tool such as a drilling machine or a powered screw driver.

One advantage with a tool bit holder according to the invention is that it is easy to insert and store a tool bit as well as removing the tool bit using only one hand. Due to that part of the main surface is arc-shaped, the arc-shaped part of the main surface functions as a guide to lead the bit to a holding position in the tool bit holder. The user thereby can store the bit in the tool bit holder by inserting the bit into the slit and letting the arc-shaped part of the main surface of the slit guide the bit to its holding position.

The main surface may comprise a front part having an extension essentially in the x-y-plane transitioning to a bottom part extending essentially in the x-z-plane. The transition between the front part and the bottom part comprises the arch-shaped part. The slit may extend past the arc-shaped part and may comprise holding means for securing the bit in the tool bit holder.

The slit may extends past the arc-shaped part and the holding means may comprise first and second holding side walls extending essentially in the y-z-plane.

The slit may extend past the arc-shaped part and the holding means may comprise a holder magnet located on a surface extending downward from the third inner side wall.

The holding side walls are and the holder magnet are arranged to secure the bit when it is placed in the tool bit holder. The holding side walls press on the bit when placed in the tool bit holder to keep it more firmly in place. The holding side walls are positioned such that at least part of the holding means presses on the bit body. The holder magnet interacts with the magnetic bit to secure the bit in the tool holder.

The outer section of the slit may be formed by that the arc-shaped part of the main surface extends past the inner section on either side of the slit.

The inner section of the slit may comprise a first inner side wall and a second inner side wall opposite the first inner side wall. The first and second inner side walls extend essentially in the y-z-plane. The first and second inner side walls extend from a surface opposite the main surface along the z-axis. The distance between the first and second side wall is greater than the width of the outer section. The function of the first and second inner side walls is to ensure that when inserting the tool bit into the slit, the tool bit is restricted in movement along the x-axis to simplify that the waist of the tool bit is received by the outer section.

The arc-shaped part may subtend an angle between 80° and 100°, more specifically 85° and 95°. In one example the radius of the arc-shaped part is between 6 mm and 10 mm, specifically between 7 mm and 9 mm.

The width of the outer section is between 4.7 mm and 7.18 mm, specifically between 4.7 mm and 6.35 mm, such that the outer section of the slit is adapted to receive the waist of a tool bit according to the standard ISO 1173:2001, Form E-6,3. The tool bit holder may be arranged to specifically receive a bit conforming to the standard ISO 1173:2001, Form E-6,3. This size of the standard is the most commonly used for tool bits. The standard ISO 1173:2001 is sometimes indicated as DIN 3126-E 6,3, ISO 1173. The slit of the tool bit holder may be adapted to fit a bit of any size of the standard or any bit comprising a waist.

The inner section of the slit may comprise a third inner side wall extending essentially in the x-y-plane. The third inner side wall ensures that the tool bit is inserted to a position such that the outer section can receive the waist of the tool bit. The third inner side wall is positioned perpendicular to the first and second inner side walls. The distance between the third inner side wall and the outer section is essentially the same as the distance between the end part of the bit and the waist of the bit. Thus, the waist of the bit is located directly above the outer section when the bit is inserted to abut the third inner side wall of the slit.

The tool bit holder may comprise a multitude of slits, wherein the distance between a centre line of two adjacent slits is less than or equal to 30 mm.

The tool bit holder may comprise a protective cover, wherein the cover comprises a first cover part extending essentially in the x-y-plane arranged past the holding side walls of the slit, transitioning to a second cover part extending essentially in an x-z-plane. The first cover part and the second cover part are arranged at an angle relative each other where the angle of the second cover part relative the first cover part is between 60° and 120°. The protective cover ensures that the bits do not harm the user of the tool bit holder by being pressed into the user's body when the user moves, squats or lying down during work. The length of the protective cover is adapted depending on the length of the bits intended to be used.

The tool bit holder may comprise an attachment portion of the tool bit holder which comprises at least one attachment portion end comprising a metallic cladding covering at least a part of the outer surface of the attachment portion end or comprising a metallic part constituting at least part of the cross section of the attachment portion end. By having at least a part of the attachment portion comprising ends made of a magnetic metal, the attachment portion ends can interact with magnets in a belt clip according in order to ensure that the first attachment portion is better secured to the belt clip.

The invention also relates to a holder arrangement where the holder arrangement comprises a tool bit holder as described above and a belt clip. The tool bit holder further comprises:

attachment means comprising a first attachment portion extending essentially along the x-axis having an essentially circular cross section in the y-z-plane. The attachment means is attached to a rear surface of the tool bit holder opposite the front part of the main surface of the tool bit holder. The belt clip of the arrangement comprises:

a compartment arranged at a first end of the belt clip, the compartment being covered by a rotatable hinged lid, wherein the compartment extends across the belt clip between a first and second end of the lid. The compartment and the lid, when the lid is closed over the compartment, form a chamber having an essentially circular cross section. A first axis of the first attachment portion when inserted into the chamber, and a second axis of the compartment are essentially coaxial.

One advantage of the holder arrangement is that by ensuring that the axes of the chamber and the first attachment portion of the tool bit holder are essentially coaxial, the lid of the belt clip cannot be opened by pushing on the tool bit holder, i.e. by applying a linear force on the tool bit holder in any direction. The first attachment portion of the tool bit holder is held in place in the chamber by that the axes are coaxial. The rotatable lid is openable only by rotating the lid itself or by rotating the tool bit holder. This ensures that the tool bit holder does not separate from the belt clip if the user accidentally bumps into an object. At the same time this function ensures that the tool bit holder separates from the belt clip if the tool bit holder gets stuck while the user is moving. This provides the arrangement with a safety feature that reduces the risk of injury to a user.

The attachment portion of the tool bit holder may comprise at least one attachment portion end comprising a metallic cladding covering at least a part of the outer surface of the attachment portion end or comprising a metallic part constituting at least part of the cross section of the attachment portion end and the belt clip may comprise at least one magnet arranged to interact with the at least one attachment portion end of the attachment portion when the tool bit holder is inserted into the belt clip. By having at least a part of the attachment portion comprising a magnetic metal, the attachment portion ends can interact with magnets in a belt clip in order to ensure that the first attachment portion remains still within the chamber of the belt clip if the attachment portion is slightly smaller than the chamber.

The invention also relates to a tool bit holder, for holding tool bits for a hand tool. The tool bit holder comprises an at least partially arc-shaped main surface, wherein the main surface is provided with an elongated slit along its arc shaped part, wherein a waist of the slit is adapted to receive the waist of a tool bit. The invention is thus not limited to tool bits according to the standard ISO 1173:2001, Form E, but can be used for any kind of tool bit comprising a waist.

DETAILED DESCRIPTION OF VARIOUS EMBODIMENTS

Although the invention is suitable to hold tool bits having a waist and more specifically tool bits having a waist according to the standard ISO 1173-E, a Male hexagon ISO 1173-E 6,3 will be used as an illustrative example. The distances mentioned below are easily changed to adapt the tool bit holder to fit a bit of a different standard or to fit a bit of a different nominal size of ISO 1173-E. The waist of a tool bit is a section of the bit which is located between a head section of the bit and a body section of the bit and which narrows to a smaller diameter than the head section of the bit and the body section of the bit.

Figure 1:
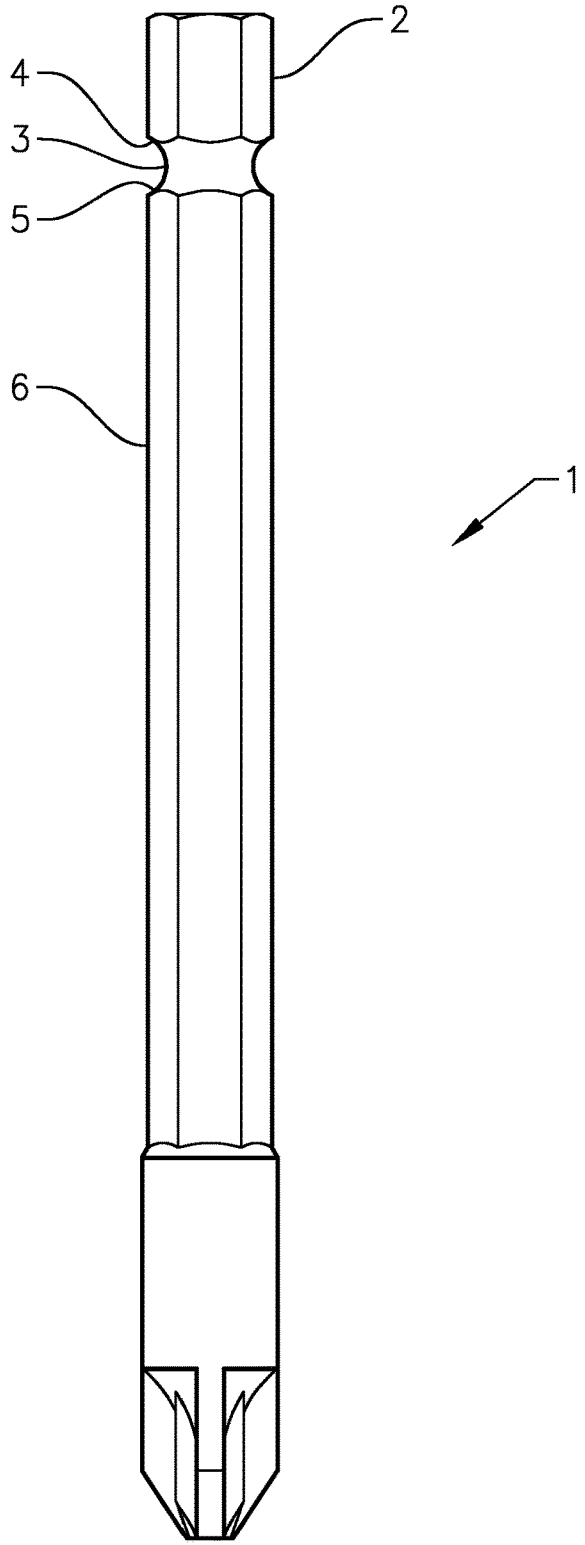
FIG. 1 schematically shows a bit conforming to Male hexagon ISO 1173-E 6,3.

FIG. 1 schematically shows a tool bit 1 conforming to Male hexagon ISO 1173-E 6,3. The tool bit 1 comprises, in an axial direction from the top, a bit head 2, a waist 3 with a first waist part 4 and a second waist part 5 and a bit body 6. The bit head 2 has a hexagonal cross section. The actual tool part 7, i.e. drill, screw drives, hole saw, etc. begins below the bit body 6. The diameter of the bit head 2 and bit body 6 is between 6.29 mm and 6.35 mm as measured between two opposite surfaces and between 7.11 mm and 7.18 mm as measured between two opposite vertices. The waist 3 is located between the bit head 2 and the bit body 6. The distance between the top of the bit head 2 and the centre, i.e. narrowest part of the waist 3 is between 9.4 mm and 9.5 mm. The smallest diameter of the waist 3 is 4.7 mm as measured with an h12 ISO tolerance. The total length of the bit head 2, waist 3 and bit body 6 is at least 25 mm. The radius of the first and second waist parts are at least 2.4 mm.

Figure 2:
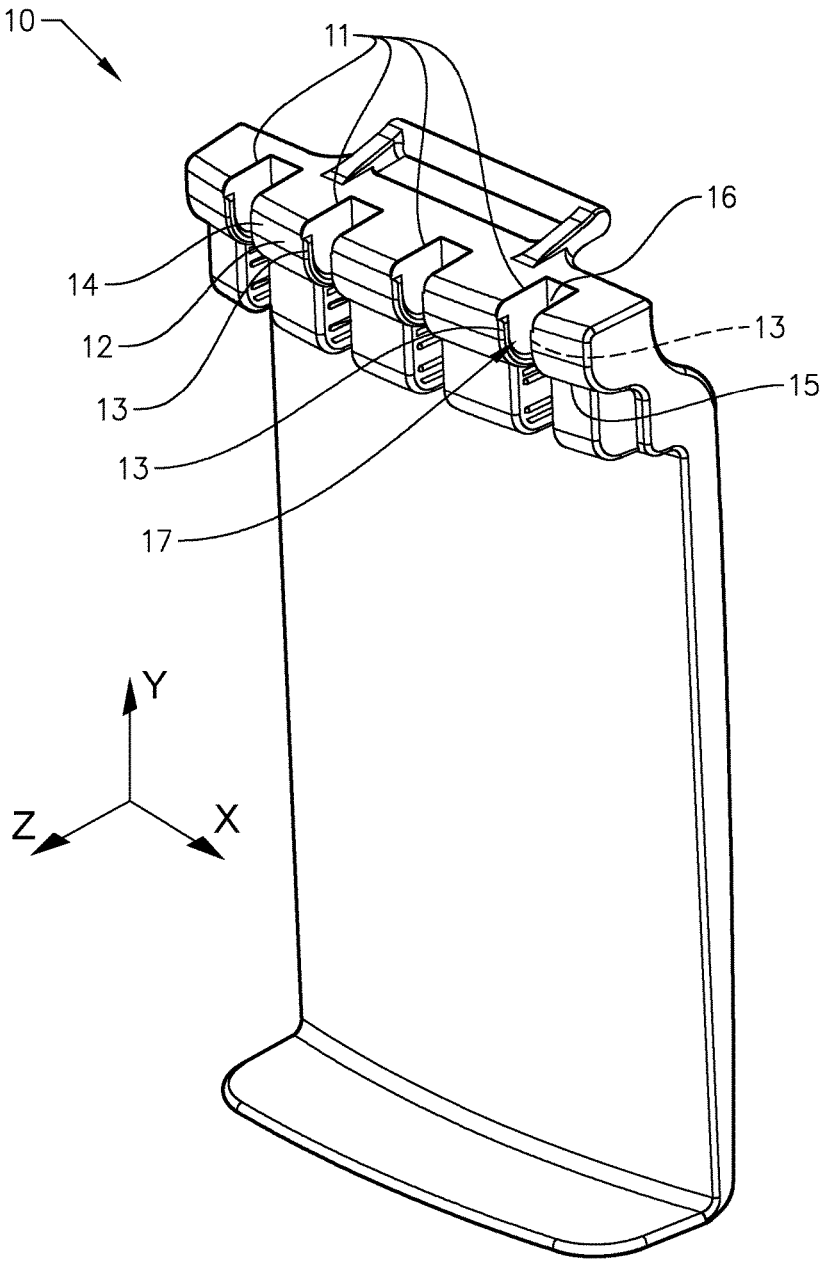
FIGS. 2 and 3 shows a perspective view of a tool bit holder according to a first example of the invention.
Figure 3:
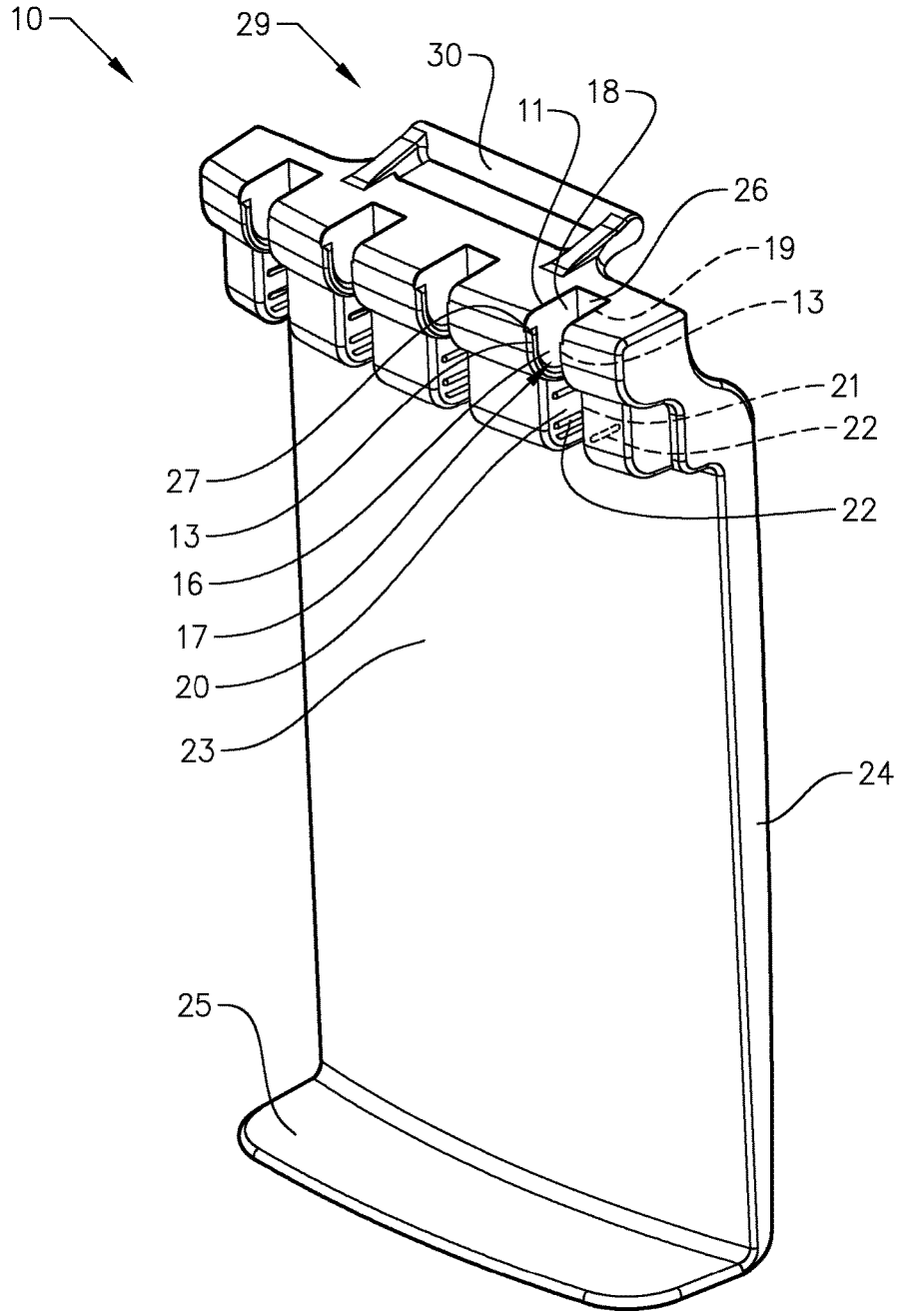

FIGS. 2 and 3 show a perspective view of a tool bit holder 10 according to the invention. The tool bit holder 10 may comprise a multitude of slits 11 for receiving and holding tool bits.

The tool bit holder 10 can be made of injection moulded plastic, metal or a combination of plastic and metal. In the context of the invention, references to upper, lower, front, rear, forward, rearward and similar directional features are merely illustrative and relative to the tool bit holder 10.

The tool bit holder 10 can be placed on a user using a belt clip or a clothing attachment or on a wall mount in any position between an essentially vertical position, and an essentially horizontal position. In the description the tool bit holder 10 according to the invention is described to hold a bit conforming to Male hexagon ISO 1173-E 6,3 alternatively DIN 3126-E 6,3, ISO 1173. It is possible for a tool bit holder 10 according to the invention to hold bits conforming to other parts of the standard, for instance Male Hexagon forms A or C or nominal dimension 4, 8 or 11,2.

The tool bit holder 10 has an extension along an x-axis, along a y-axis being perpendicular to the x-axis, and along a z-axis being perpendicular to the x-axis and y-axis. The tool bit holder 10 in the example of FIG. 2 is oriented in the way it is intended to be when worn by a user when standing in an upright position. The x-axis is in the example of FIG. 2 directed along the horizontal direction of the tool bit holder 10, i.e. from one side of the tool bit holder 10 to the other or left to right. The y-axis is directed along a vertical direction of the tool bit holder 10, i.e. along the height of the tool bit holder 10 or top to bottom. The z-axis is directed along the direction of depth of the tool bit holder 10 or front to rear. Any other orientation of a coordinate system or a different coordinate system can be used to describe the positional relationship of the various parts of the tool bit holder 10.

The tool bit holder 10 comprises an at least partially arc-shaped main surface 12 where an arc-shaped part 13 of the main surface 12 at least partially transitions between the y-axis to the z-axis. The main surface 12 has an extension at least in the x-y-plane and the x-z-plane where a front part 14 of the main surface 12 has an extension essentially in the x-y-plane transitioning to a bottom part 15 of the main surface 12 extending essentially in the x-z-plane. The transition between the front part 14 and the bottom part 15 comprises the arch-shaped part. The arc-shaped part 13 may be continuous having only one radius over the entire arc-shaped part 13 or comprise a multitude of arc segments, each with their respective radius.

The main surface 12 is in the example of FIG. 2 provided with four elongated slits 11 extending at least along the arc-shaped part 13 essentially along the x- and y-axis. As the slits' 11 function is the same, only one slit 11 will be described. The slit 11 is provided with an inner section 16 and an outer section 17. The outer section 17 is level with the main surface 12 and is in one example formed by that arc-shaped parts 13 of the main surface 12 extends past the inner section 16 on either side of the slit 11 along the x-axis. The outer section 17 may also be formed by for instance attaching arc-shaped portions as extensions of the main surface 12. The inner section 16 is wider than the outer section 17. The distance between the extensions of the outer section 17 on either side of the slit 11 determines the width of the outer section 17. The difference in width of the inner section 16 and width of the outer section 17 makes the outer section 17 adapted to receive the waist of a tool bit according the standard ISO 1173:2001, Form E.

FIG. 3 shows a perspective view of the tool bit holder 10 according to the invention. The inner section 16 of the slit 11 comprises a first inner side wall 18 and a second inner side wall 19 opposite the first inner side wall 18. The first and second inner side walls 18, 19 face each other with the faces pointing essentially along the x-axis. The first and second inner side walls 18, 19 extend essentially in the y-z-plane. The first and second inner side walls 18, 19 extend backwards from a surface opposite the main surface 12 along the z-axis. The distance between the first and second inner side walls 18, 19 is greater than the width of the outer section 17. The distance between the first and second inner side wall 18, 19 is in one example less than 7.18 mm such that the tool bit orients itself in the slit 11 with the plane surfaces of the tool bit head lying against the first and second inner side walls 18, 19. The extent of the first inner side wall 18 and the second inner side wall 19 in a rearwards direction along the z-axis is in a first example at least 5.35 mm such that the first and second side surfaces have the same extent as an outer surface of a bit head of the tool bit to be held in the slit 11.

In the described example, the slit 11 extends downwards along the y-axis past the arc-shaped part 13 and comprises holding means in the shape of first and second holding side walls 20, 21 extending essentially in the y-z-plane. The first and second holding side walls 20, 21 may be smooth or comprise holding protrusions 22. The first and second holding side walls 20, 21 are arranged to press against a tool bit when it is placed in the slit 11 in order to keep the tool bit in place. The distance between the holding side walls 20, 21 or the holding protrusions 22 is less than or equal to 7.18 mm, preferably less than 6.35 mm. The first and second holding side walls 20, 21 may be resilient such that they flex when the tool bit 1 enters between the first and second holding side walls 20, 21 and thereafter press against the tool bit 1 in order to ensure an even better holding of the tool bit 1.

Extending further downwards along the y-axis, the tool bit holder 10 comprises a protective cover 23. The cover comprises a first cover part 24 extending essentially in the x-y-plane arranged downwards past the first and second holding side walls 20, 21 of the slit 11 along the y-axis. The first cover part 24 transitions to a second cover part 25 extending essentially in an x-z-plane. The first cover part 24 and the second cover part 25 are arranged at an angle relative each other. The angle of the second cover part 25 is between 60° and 120° relative the first cover part 24, specifically between 80° and 100°.

The tool bit holder 10 in this example comprises a slit 11 where the slit 11 comprises a third inner side wall 26 extending essentially in the x-y-plane. The third inner side wall 26 is essentially perpendicular to the first and second inner side walls 18, 19 and is placed rearward of the first and second inner side walls 18, 19 at a distance from the outer section 17 such that the waist of the tool bit when the tool bit is inserted into the slit 11, is in a position to be received by the outer section 17. The distance from an uppermost part 27 of the arc-shaped part 13 to the third inner side wall 26 is between 7.25 mm and 11.75 mm. The smaller distance corresponds to the length of the bit head, i.e. the distance to the beginning of the waist in an axial direction of the bit. The larger distance corresponds to the length of the bit head plus the length of the waist, i.e. the distance to the end of the waist. In this way the outer section 17 of the slit 11 will always fit within the waist of the bit, when the bit is inserted such that the bit head abuts the third inner side wall 26. This leads to an easy insertion of the bit and allows a user to depend on tactile feedback only when inserting the bit. The third inner side wall 26 may in this example be a thin strip or a surface connecting the first and second inner side walls 18, 19 or a surface extending downwards in the x-y-plane placed rearward of the first and second inner side walls 18, 19. The opening being delimited by the outer section 17 and the first, second and third inner side walls 18, 19, 26 comprise an insertion opening 28 for the tool bit. The tool bit is thus inserted into the slit 11 from above by moving it downwards along the y-axis until the waist of the tool bit is received by the outer section 17 of the slit 11.

The slit 11 may also comprise a curved inner part arranged to receive the waist of the tool bit when the tool bit is in its holding position.

The inner side walls in this example comprise a bevelled upper part. The upper parts can also be chamfered or filleted. The outer section 17 in this example have rounded inner edges with a radius of less than 2.4 mm, corresponding to the radius of the waist parts of the tool bit. These surfaces all simplify the insertion of the tool bit into the slit 11.

In FIG. 3, an attachment means 29 extending essentially in the x-z-plane a first attachment portion 30 of the tool bit holder 10 can be seen. The attachment means 29 comprises a first attachment portion 30 extending essentially along the x-axis having an essentially circular cross section in the y-z-plane. The attachment means 29 is attached to the tool bit holder 10 such that the first attachment portion 30 is separated a distance from a rear surface of the tool bit holder 10. In FIG. 3 the attachment means is attached to a rear and top surface at a top end of the tool bit holder 10. The attachment means can be placed on other rear surfaces of the tool bit holder 10 along the y-axis or to a top surface of the tool bit holder 10.

Figure 4:
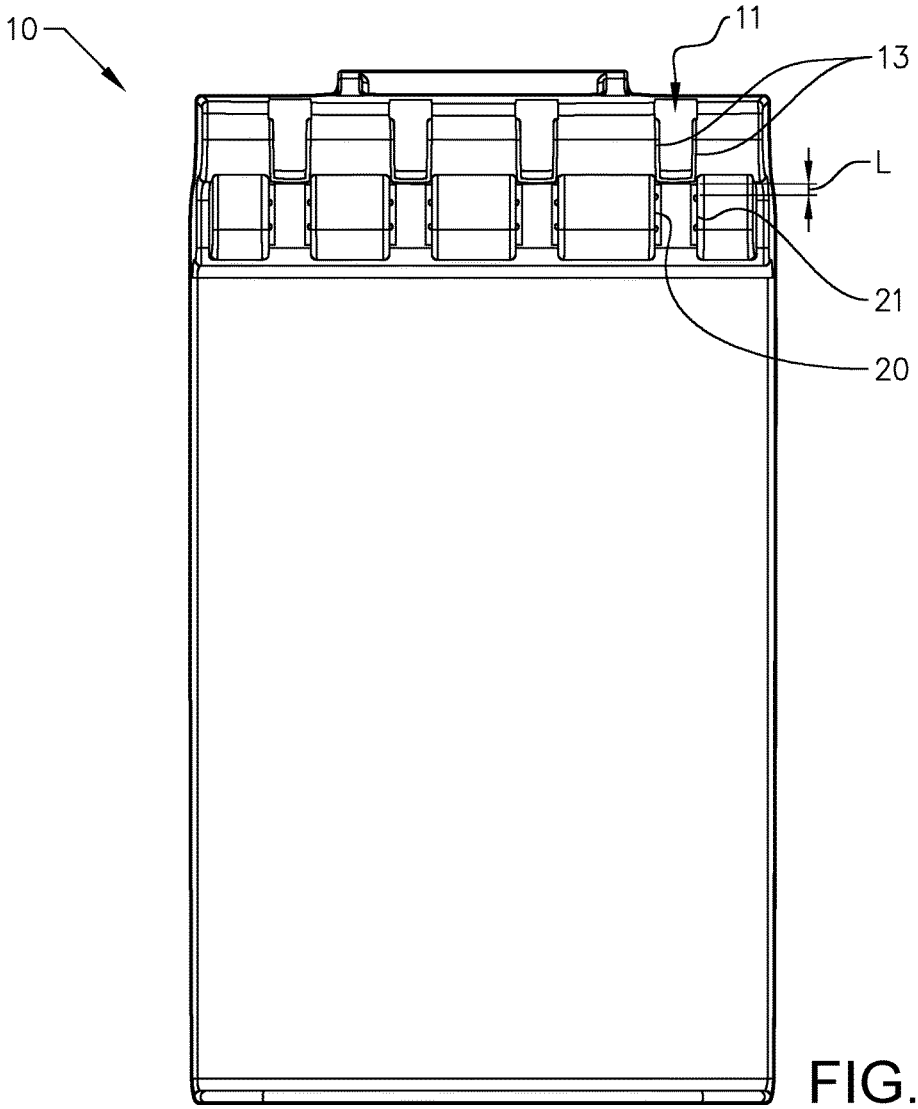
FIG. 4 shows a front view of a tool bit holder according to a first example of the invention.

FIG. 4 schematically shows a front view of a tool bit holder 10 according to the invention. The distance L from the upper most part of the first and second holding side walls 20, 21 to the lower most part of the outer section 17 is less than 15.6 mm. This ensures that the holding means always fall within the length of the bit body. The length of the first and second holding side walls 20, 21 is between 2 mm and 20 mm.

Figure 5:
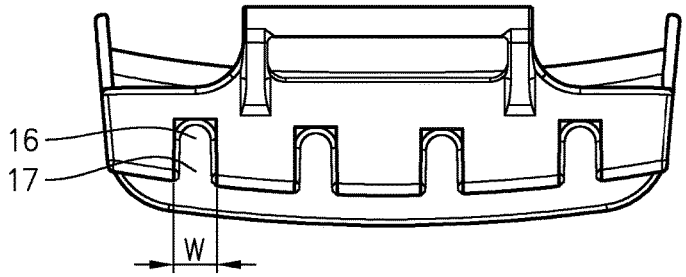
FIG. 5 shows a top view of a tool bit holder according to a first example of the invention.

FIG. 5 schematically shows a top view of a tool bit holder 10 according to the invention. The width W of the outer section 17 is at least 4.7 mm and at most 7.18 mm in order for the waist of the bit according to the above to be received by the outer section 17. The range of the width W corresponds to the smallest diameter of the waist of the bit to the maximum diameter of the bit head.

Figure 6:
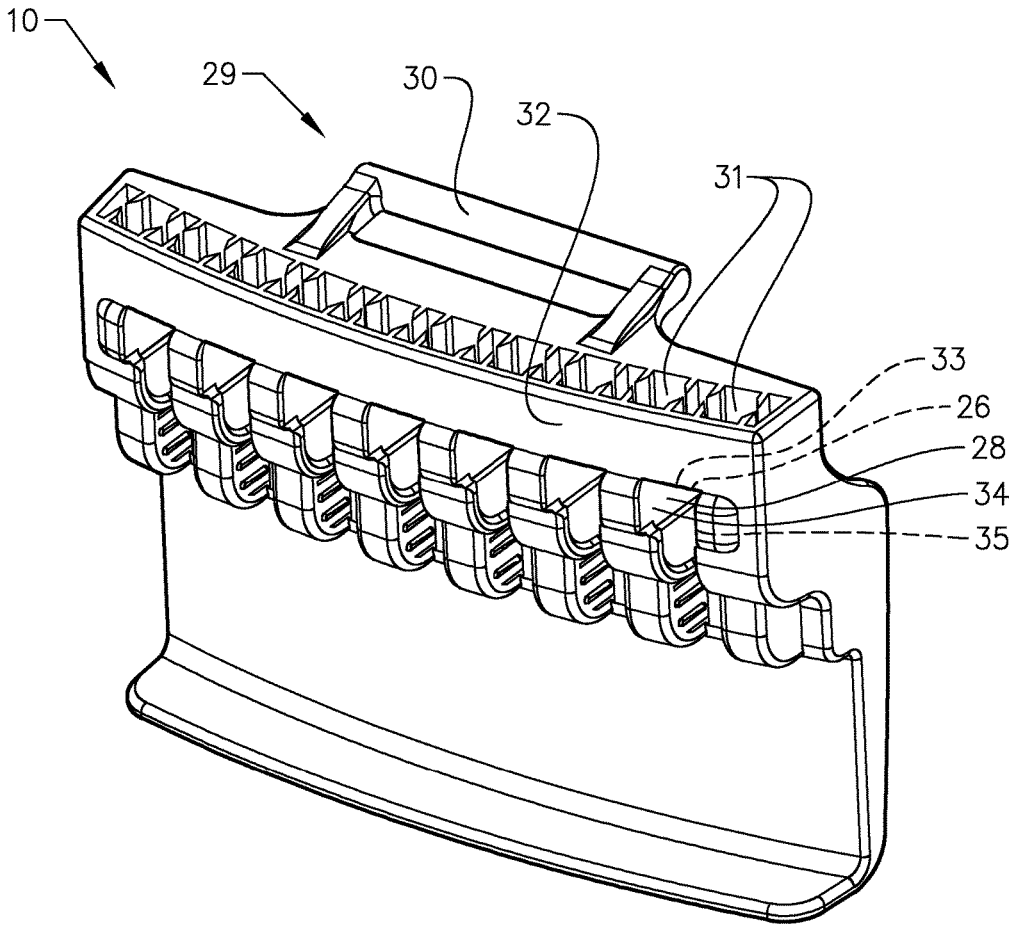
FIG. 6 shows a tool bit holder according to a second example of the invention.

FIG. 6 schematically shows a second example of tool bit holder 10 according to the invention. In addition to what is described above, this example of the tool bit holder 10 comprises slots 31 suitable for storing drive bits. Drive bits are generally shorter than bits conforming to Male hexagon ISO 1173-E 6,3 and are generally stored in bit holders having an interface interacting with the hexagonal cross section of the drive bit. These interfaces are known in the art. A row 32 of slots 31 for drive bits is placed on top of the tool bit holder 10 along the x-direction covering the slits 11. An insertion opening 28 is formed by a downward facing surface 33 of the row 32 of slots 31 and by a first opening surface 34 and second opening surface 35 connecting the first and second inner side walls 18, 19 respectively with the bottom surface of the row 32 of slots 31. The distance between the first and second opening surfaces 34, 35 is greater than the distance between the first and second inner side walls 18, 19. In this example the insertion opening 28 is facing forwards along the z-axis. The third inner side wall 26 is in this example made up of a surface extending downwards along the y-axis from the downward facing surface 33 of the row 32 of slots 31. The distance to the third inner side wall 26 from the uppermost part 27 of the outer section 17 is the same as in the first example. The distance between the first and second opening surfaces 34, 35 is at least 7.18 mm to ensure that the bit head fits in any direction. The tool bit holder 10 according to this example is otherwise similar to the tool bit holder 10 as described in conjunction with FIGS. 2-4.

In FIG. 6, an attachment means of the tool bit holder 10 extending essentially along the x-axis can be seen. The attachment means comprises a first attachment portion 30 having an essentially circular cross section essentially in the y-z-plane. The attachment means is attached to the tool bit holder 10 as described in conjunction with FIG. 3. In FIG. 6 the attachment means is attached to a rear surface at a top end of the tool bit holder 10 at the row 32 of slots 31. The attachment means can be placed on other rear surfaces of the tool bit holder 10 along the y-axis.

Figure 7A:
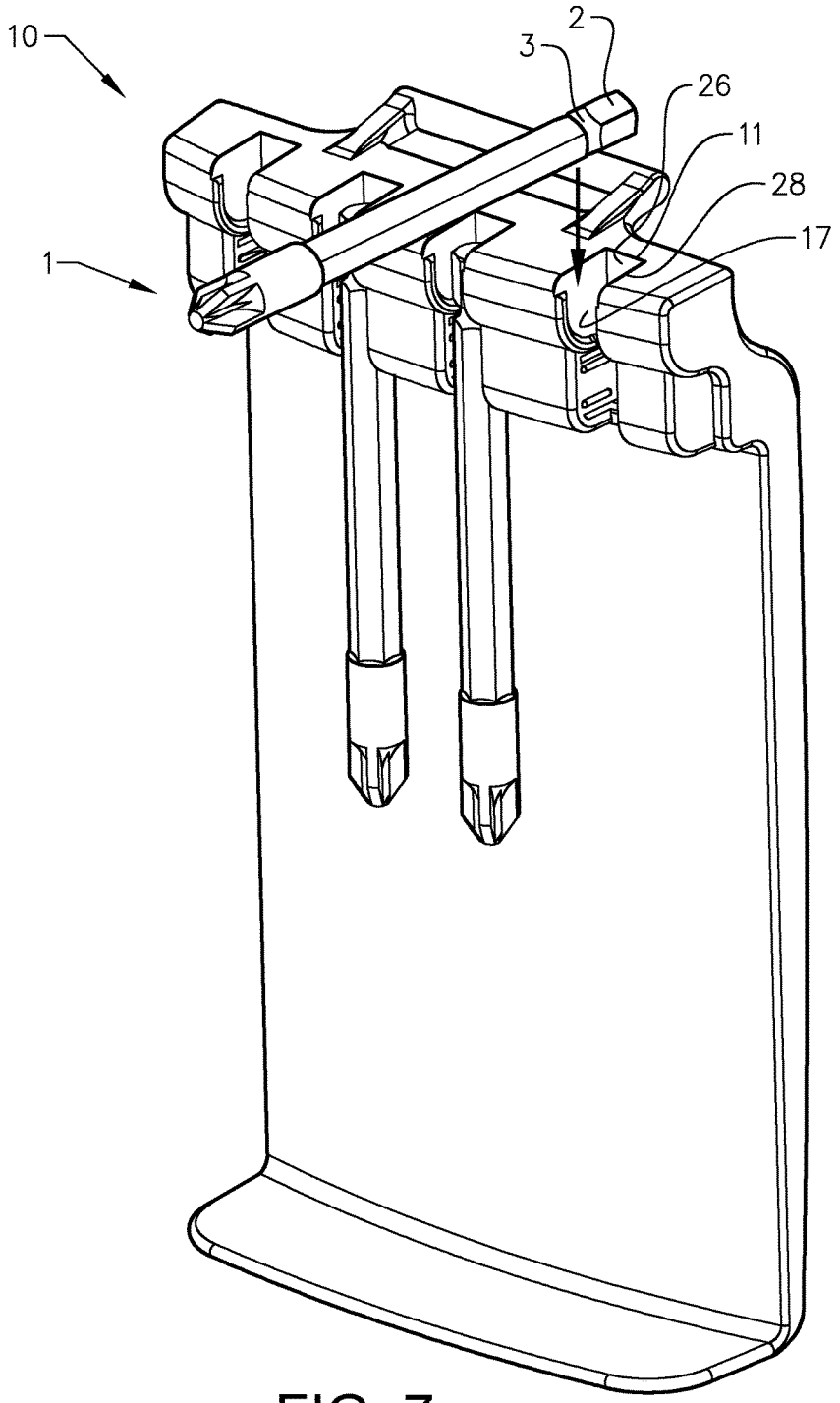
FIG. 7*a*-7*c* schematically shows a method for inserting a tool bit into a slit of the tool bit holder according to a first example of the invention.
Figure 7B:
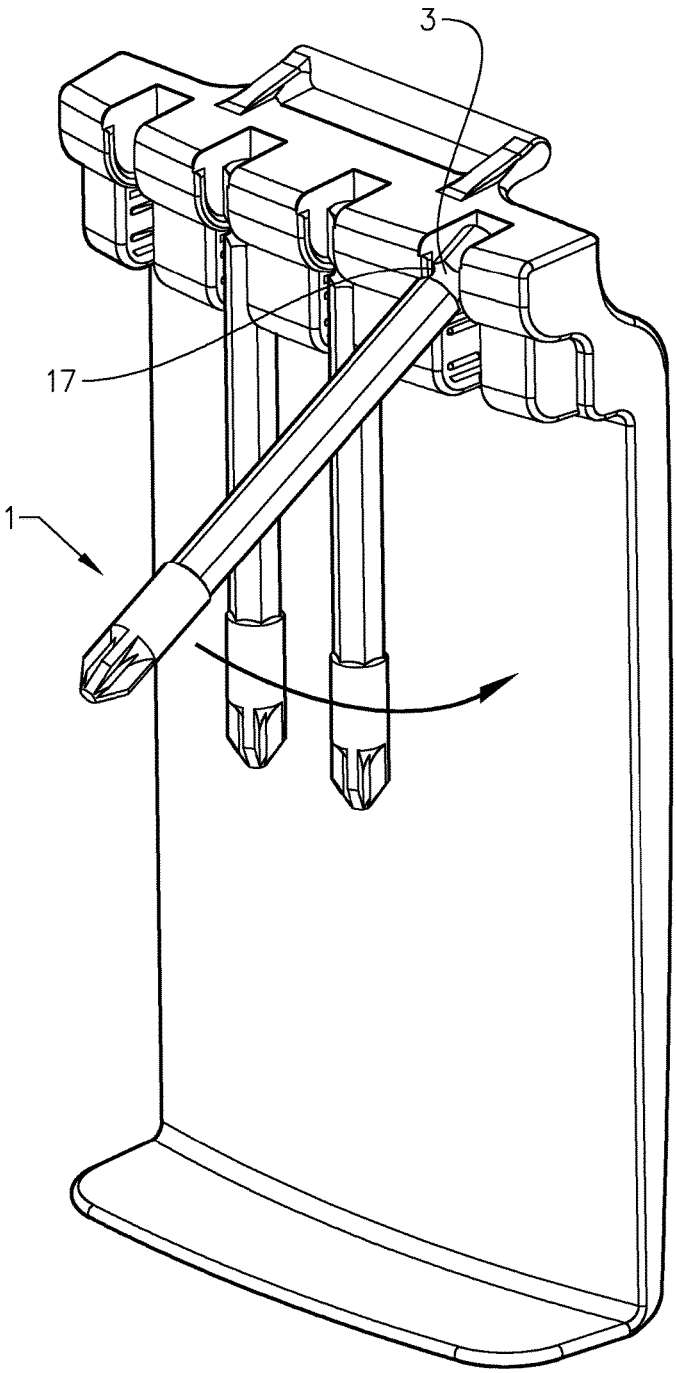
Figure 7C:
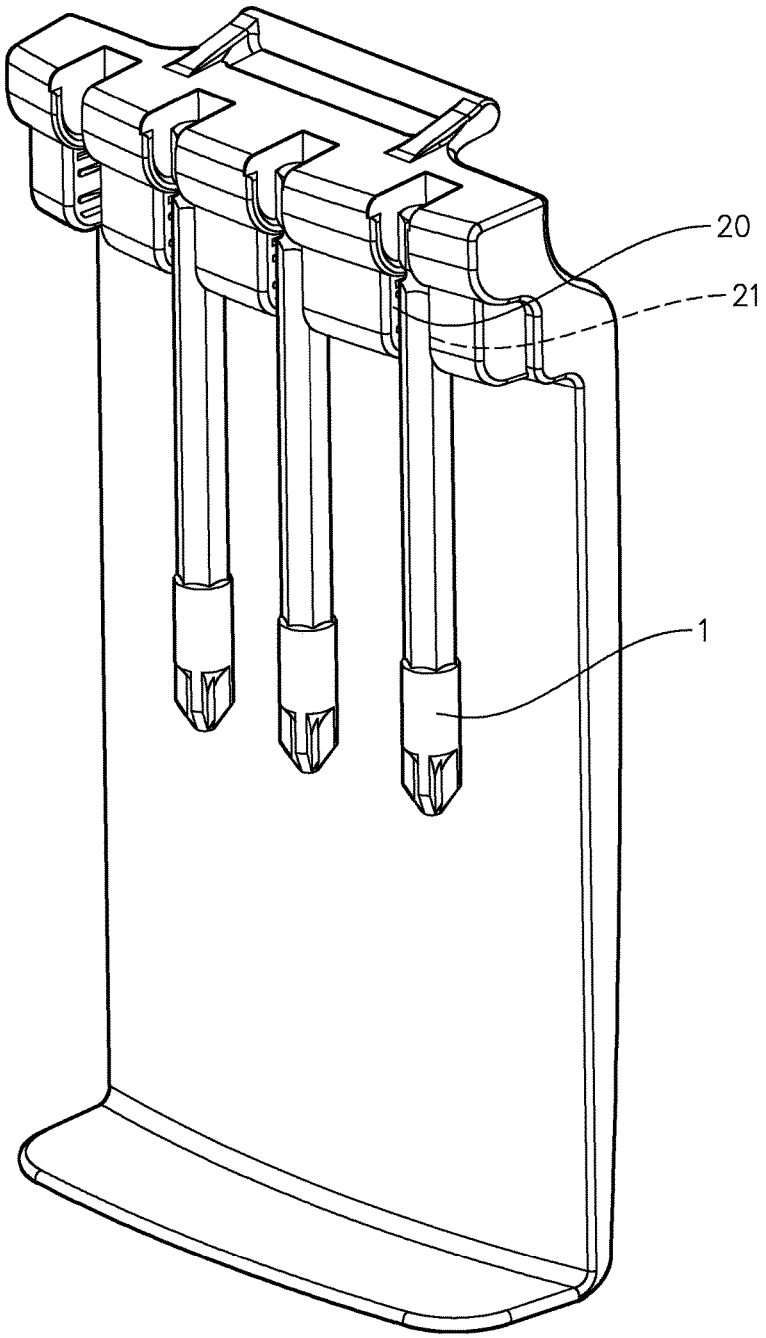

FIGS. 7*a*-7*c* schematically shows a method for inserting a tool bit 1 into a slit 11 of the tool bit holder 10 according to the first example of the invention.

In the first example, the insertion opening 28 faces upwards, as described in conjunction with FIGS. 2-4. A first step of inserting the bit is shown in FIG. 7*a*. A bit is inserted into slit 11 from above, the bit being held essentially perpendicular to the tool bit holder 10 with the axis of the tool bit 1 facing along the z-axis. The tool part 7 of the bit points away from the front of the tool bit holder 10. The bit head is inserted downwards into the insertion opening 28 until the waist 3 of the bit is received by the outer section 17. The bit head is preferably, but not necessarily, inserted such that it abuts the third side wall in order for easier insertion.

A second step of inserting the bit into the tool bit holder 10 is shown in FIG. 6*b*. The waist 3 of the bit has been received by the outer section 17 and the bit is moved further downwards. This leads to that the bit starts to follow the curvature of the outer section 17 when the bit continues to be moved downwards in the slit 11. The tool part 7 follows a curved trajectory downwards/backwards.

A third step of inserting the bit into the tool bit holder 10 is shown in FIG. 6*c*. In the final step the bit is placed in its holding position between the first and second holding side walls 20, 21 of the slit 11.

In order to remove the bit from the tool bit holder 10, the steps are performed in the opposite order.

Figure 8A:
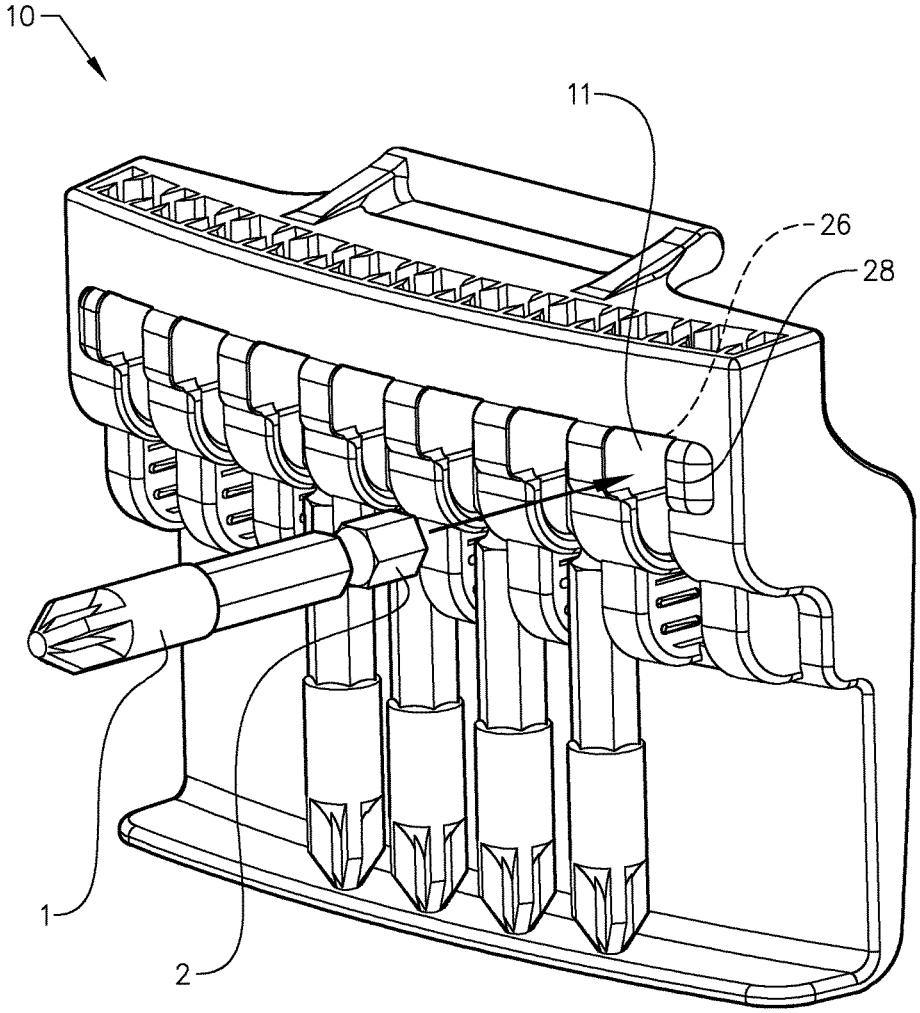
FIG. 8*a*-8*c* schematically shows a method for inserting a tool bit into a slit of the tool bit holder according to a second example of the invention.
Figure 8B:
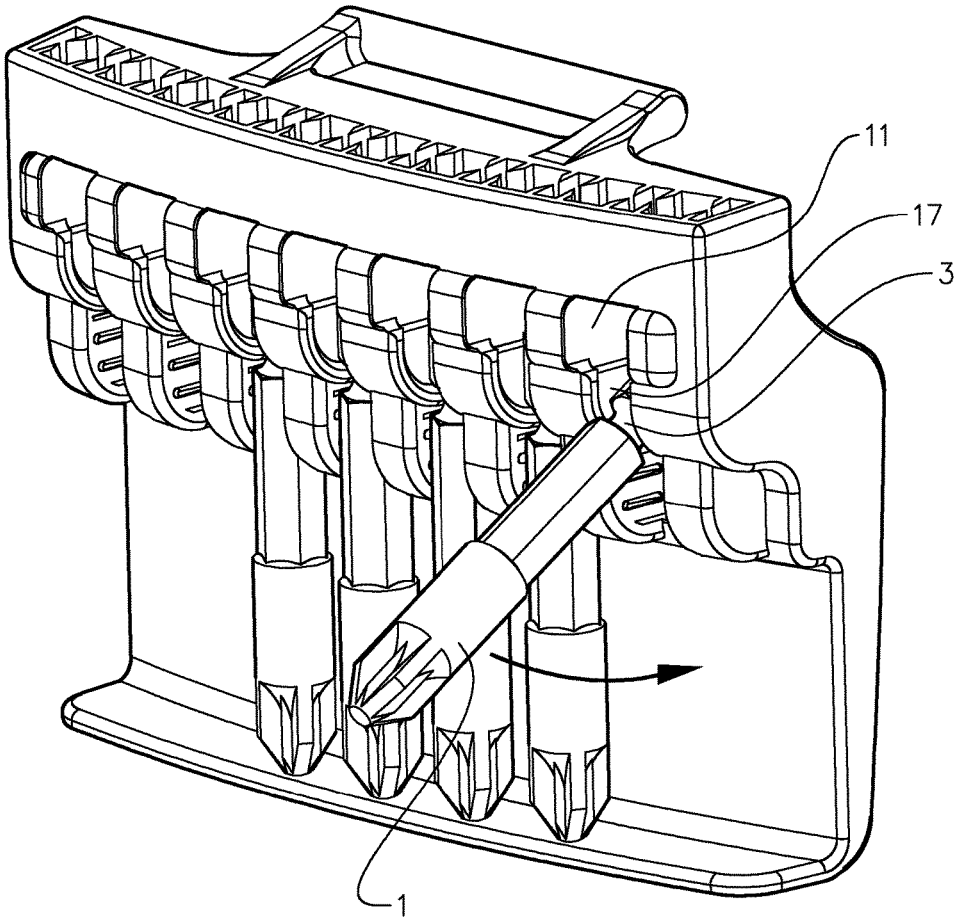
Figure 8C:
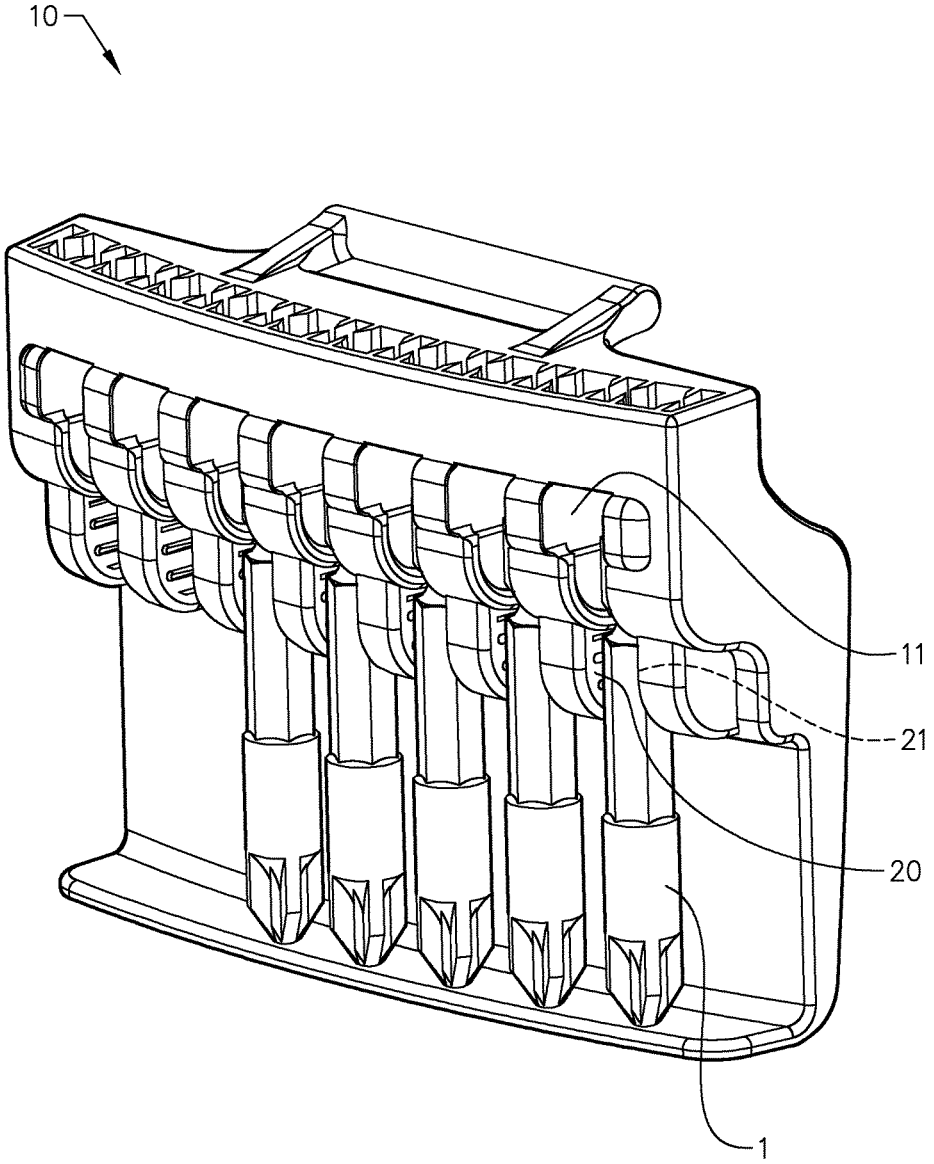

FIGS. 8*a*-8*c* schematically shows a method for inserting a tool bit 1 into a slit 11 of the tool bit holder 10 according to the second example of the invention.

In the second example, the insertion opening 28 faces forward as described in conjunction with FIG. 6. A first step of inserting the bit is shown in FIG. 8*a*. A bit is inserted into insertion opening 28 the front of the tool bit holder 10, with the bit being essentially perpendicular to the tool bit holder 10, in the same way as in the first example. The tool part 7 of the bit points away from the front of the tool bit holder 10. The bit head is inserted into the insertion opening 28 by moving the bit rearward. The bit head is preferably, but not necessarily, inserted such that it abuts the third inner wall in order for easier insertion.

A second step of inserting the bit into the tool bit holder 10 is shown in FIG. 8*b*. The bit is moved downwards such that the waist 3 of the bit is received by the outer section 17. This leads to that the bit starts to follow the curvature of the outer section 17 when the bit continues downwards in the slit 11 and the tool part 7 follows a curved trajectory downwards/backwards.

A third step of inserting the bit into the tool bit holder 10 is shown in FIG. 7*c*. In the final step the bit is placed in its holding position between the holding means.

In order to remove the bit from the tool bit holder 10, the steps are performed in the opposite order. The tool bit holder 10 is otherwise similar to the first example.

The tool bit holder 10 can be curved, as shown in FIG. 2, or straight. When the tool bit holder 10 is curved at least the front part 14 of the main surface 12 and the first cover part 24 of the protective cover 23 arcs slightly forward but still have a principal extension along the x-y-plane. An arced tool bit holder 10 makes the tool bit holder 10 more comfortable to wear as it conforms to a curved surface of the body of a user such as the thigh or hip. Other suitable body part where the tool bit holder 10 can be worn is for instance the chest, upper arm or lower arm.

When the tool bit holder 10 comprises a multitude of slits 11, the distance between a centre line of two adjacent slits 11 is less than or equal to 30 mm. A tool bit holder 10 with multiple slits 11 separated by a distance of less than or equal to 30 mm ensures that a tool bit holder 10 can hold drill or hole saw bits with diameters of up to 30 mm.

Figure 9:
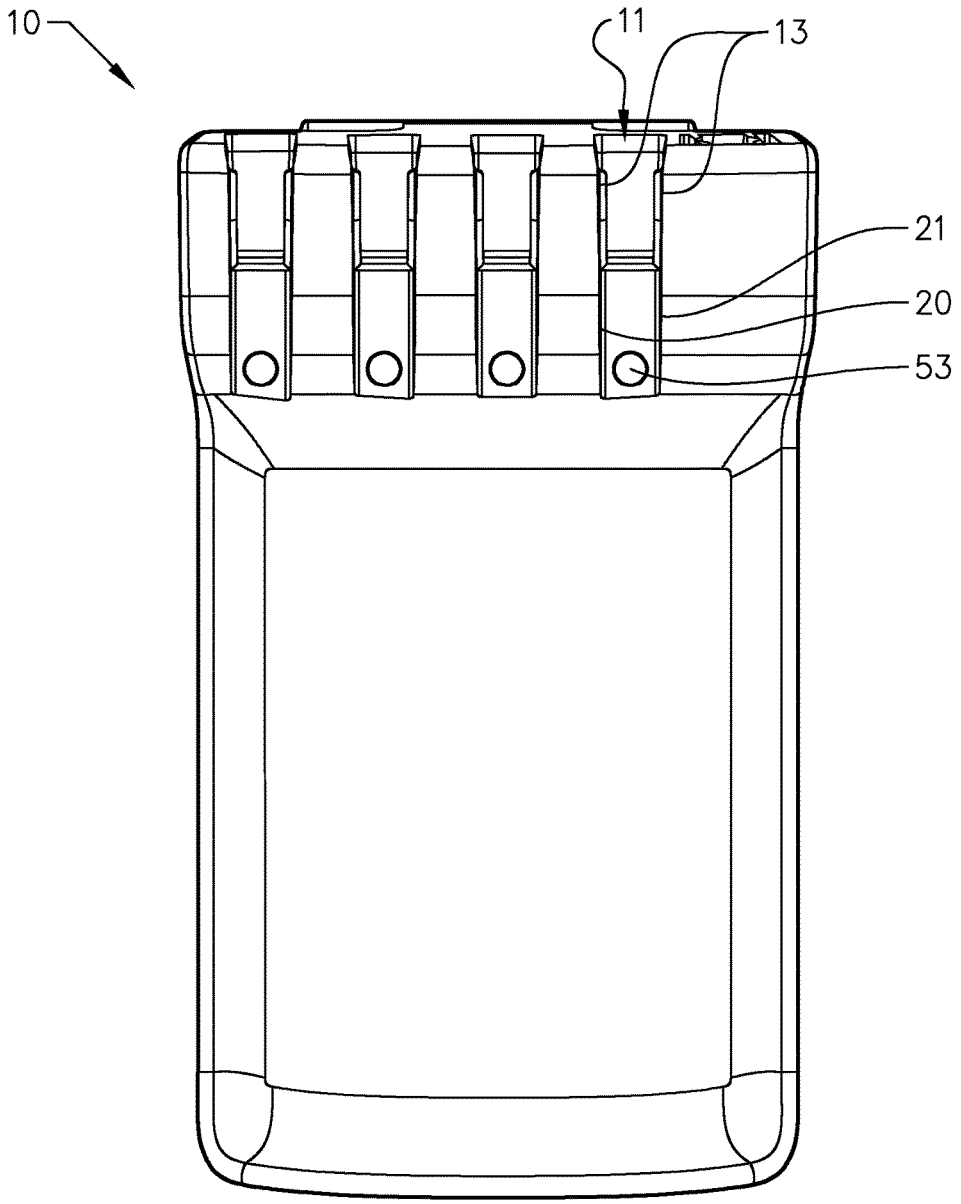
FIG. 9 shows a front view of a tool bit holder comprising an alternative example of holding means.

FIG. 9 schematically shows a front view of a tool bit holder 10 comprising an alternative example of a holding means. In the alternative example, the holding side walls are smooth and do not press against the bit 1. The holding means in this example comprises a holder magnet 53 which is arranged to secure the bit 1 to the tool bit holder 10 by means of magnetic force acting on the bit 1. The holder magnet 53 is located on a surface extending downward from the third inner side wall 26. The centre of the magnet is placed at a distance of between 10 mm and 15 mm from the lower most part of outer section 17. This ensures that the holding means always fall within the length of the bit body. The length of the first and second holding side walls 20, 21 is between 2 mm and 20 mm. The alternative holding means can be incorporated into both the first and second examples described above in conjunction with FIGS. 2-4 and 6 respectively.

Figure 10A:
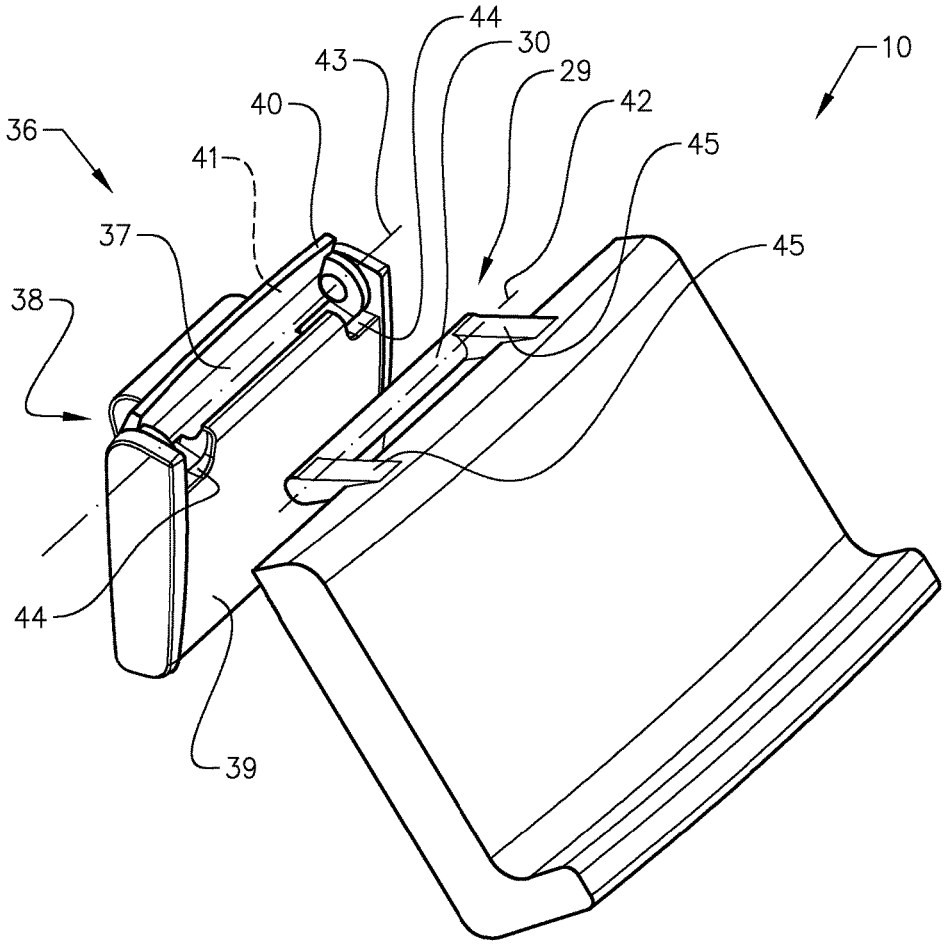
FIGS. 10*a* and 10*b* show two examples of holder arrangements according to the invention.

FIG. 10*a* shows a first example of a holder arrangement, wherein the holder arrangement comprises a tool bit holder 10 according to the description above and a belt clip 36.

The belt clip 36 comprises a compartment 37 arranged at a first end 38 of a belt clip body 39 of the belt clip 36. The first end 38 is arranged at an upper end of the belt clip body 39. The compartment 37 is covered by a rotatable hinged lid 40. The compartment 37 extends across the belt clip 36 between a first and second end of the lid 40 along the x-axis. The compartment 37 and the lid 40, when the lid 40 is closed over the compartment 37, form a chamber 41 having an essentially circular cross section in the y-z-plane. A first axis 42 of the first attachment portion 30, when inserted into the chamber 41, and a second axis 43 of the compartment 37 and effectively of chamber 41 are essentially coaxial. As mentioned above, the fact that the axes of the chamber and the first attachment portion of the tool bit holder are essentially coaxial results in that the lid of the belt clip cannot be opened by pushing on the tool bit holder, where pushing is understood to mean applying a linear force on the tool bit holder in any direction. The first attachment portion of the tool bit holder is held in place in the chamber by that the axes are coaxial. No force is thereby transferable from the first attachment portion on the lid which would create a torque, opening the lid. The rotatable lid is openable only by rotating the lid itself or by rotating the tool bit holder. This ensures that the tool bit holder does not separate from the belt clip if the user accidentally bumps into an object. At the same time this function ensures that the tool bit holder separates from the belt clip if the tool bit holder gets stuck while the user is moving, for instance if the user is moving downwards on a ladder and the tool bit holder is caught on an object. Without this safety feature the user would risk falling from the ladder and risk injury or risk damage to equipment or clothing.

The belt clip body 39 comprises two compartment openings 44 leading into the compartment 37. In one example the attachment means 29 of the tool bit holder 10 comprises two second attachment portions 45 attached to the first attachment portion 30 and to the tool bit holder 10. The second attachment portions 45 are arranged to fit in the compartment openings 44 of the belt clip 36 upon engaging the tool bit holder 10 to the belt clip 36.

Figure 10B:
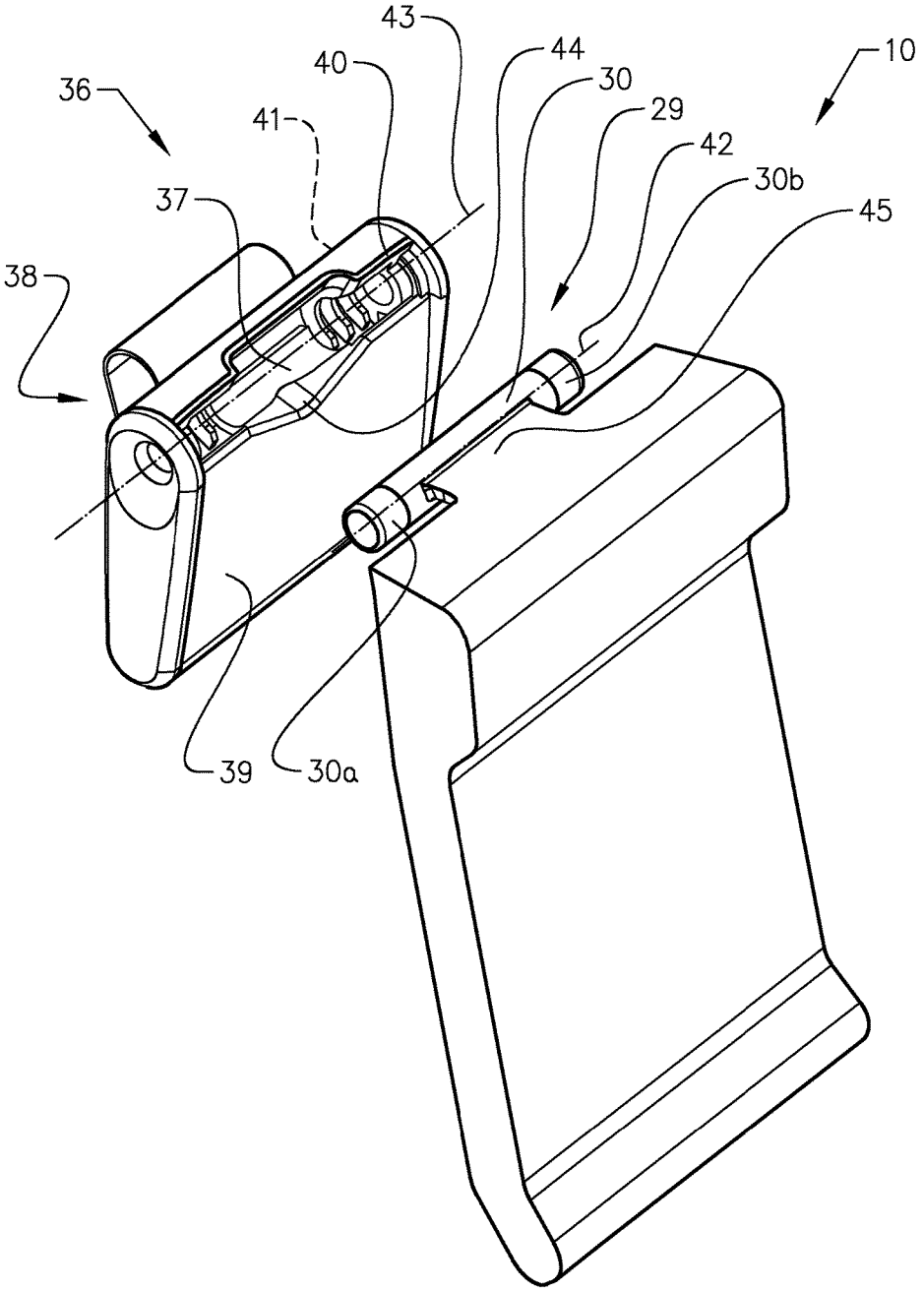

FIG. 10*b* shows a second example of a holder arrangement, wherein the holder arrangement comprises a tool bit holder 10 according to the description above and a belt clip 36.

In the second example the belt clip body 39 comprises one compartment opening 44 leading into the compartment 37. In the second example the attachment means 29 of the tool bit holder 10 comprises one second attachment portion 45 attached to the first attachment portion 30 and to the tool bit holder 10. The second attachment portion 45 is arranged to fit in the compartment opening 44 of the belt clip 36 upon engaging the tool bit holder 10 to the belt clip 36.

The first attachment portion 30 comprises in the second example attachment portion ends 30*a* and 30*b* which may comprise metal cladding covering a part of or the entire jacket surface of the attachment portion ends 30*a*, 30*b*. The attachment portion ends 30*a*, 30*b* may alternatively be made up of a solid metal part extending over a part of or over the whole of the cross section of the attachment end portion 30*a*, 30*b*. The attachment portion ends 30*a*, 30*b* may extend over the entire length of the attachment portion 30 or extend over only a part of the length of the attachment portion 30. The metal is a magnetic metal. Metallic attachment portion ends 30*a* and 30*b* may also be arranged in the first example described in conjunction with FIG. 10*a*.

Figure 11:
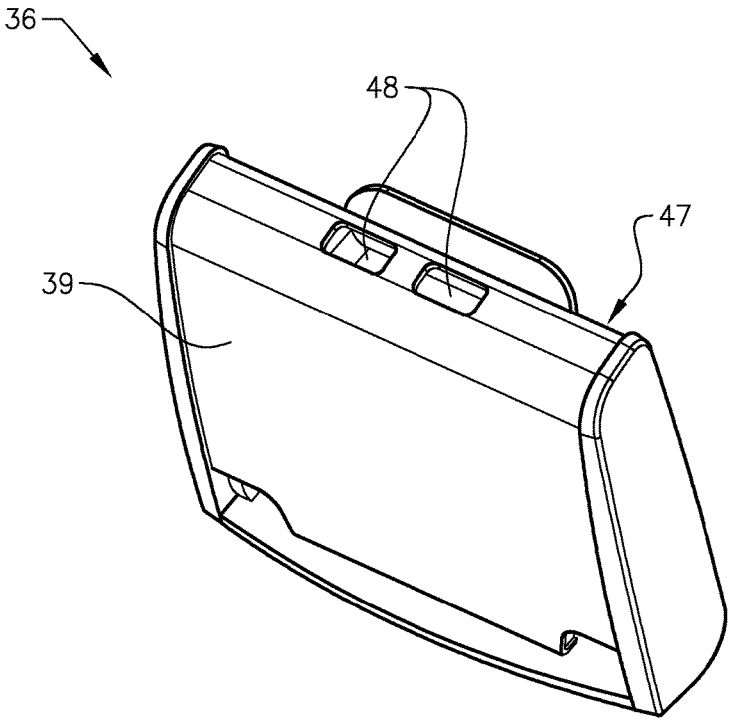
FIG. 11 shows a bottom view of the belt clip of the holder arrangement.

In the second example the belt clip 36 comprises one or magnets. This will be described in more detail below. FIG. 11 shows a bottom view of the belt clip 10. The belt clip body 39 further comprises a pair of item openings 48 located at a bottom end 47 of the belt clip body 39. The item openings 48 at the bottom of the belt clip 36 allow a user to attach various items to the belt clip 36 to ensure that these items are always reachable when needed and also to ensure that whenever the belt clip 36 is worn these items will not be forgotten. Examples of items are ID card holders, key card holders.

FIGS. 12*a*-12*d* shows a cross sectional view of a first example of the tool bit holder 10 and the belt clip 36.

Figure 12A:
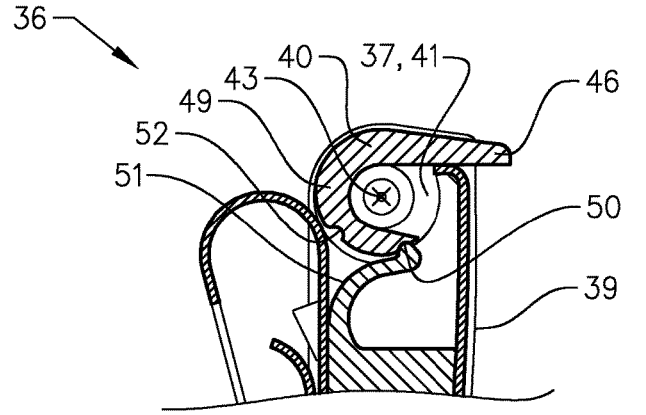
FIGS. 12*a*-12*h* show cross sectional views of the tool bit holder and the belt clip of the holder arrangement.

FIG. 12*a* shows the belt clip 36 in a closed position. The lid 40 comprises a lip 46 extending forward a vertical extension of the belt clip body 39. The lip 46 can be used for simpler opening of the lid 40 by simply running one or more fingers upwards over the belt clip body 39 until the lip 46 is reached and the lid 40 can be pushed open.

A hinge 49 of the rotatable lid 40 may comprise a first groove 50 arranged to engage with a flexible arm 51, wherein upon engagement of the first groove 50 and the arm 51, the lid 40 is held in a first position. A hinge 49 of the rotatable lid 40 may further comprise a second groove 52 arranged to engage with the flexible arm 51, wherein upon engagement of the second groove 52, the lid 40 is held in a second position. FIG. 12*a* shows the first position which is a closed position. Chamber 41 is formed by the compartment 37 and the lid 40 closing over the compartment 37. The second axis 43 of the chamber 41 is seen to be essentially coaxial with the rotational axis of the lid 40 which is the rotational axis of the hinge 49.

Figure 12B:
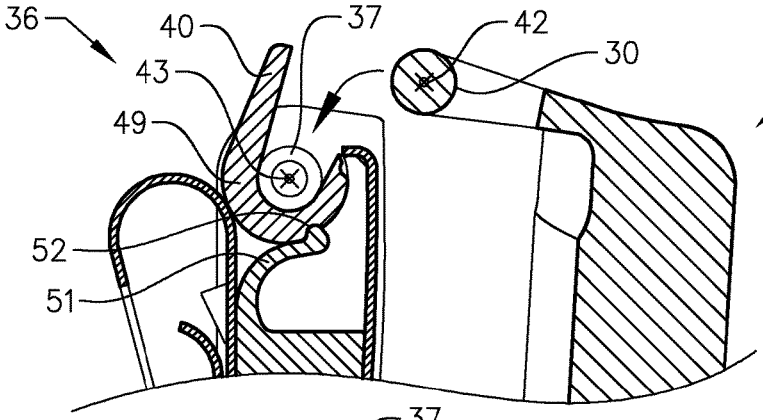

FIG. 12*b* shows the tool bit holder 10 being inserted into the compartment. The first attachment portion 30 is inserted into the compartment 37. In FIG. 12*b* the second groove 52 of the hinge 49 is engaged with the flexible arm 51. The second position is an open position. One or both hinges 49 of the lid 40 can have first and second grooves 50, 52. Flexible arm 51 can thus be present on both sides of the belt clip 10.

Figure 12C:
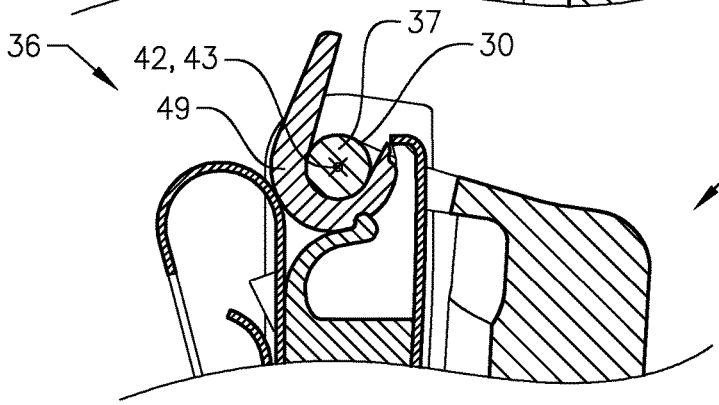

FIG. 12*c* shows the first attachment portion 30 inserted into the compartment 37. The first axis 42 of the first attachment portion 30 is as seen from the figure essentially coaxial with the rotational axis of the hinge 49 and of the second axis 43 of the compartment 37.

Figure 12D:
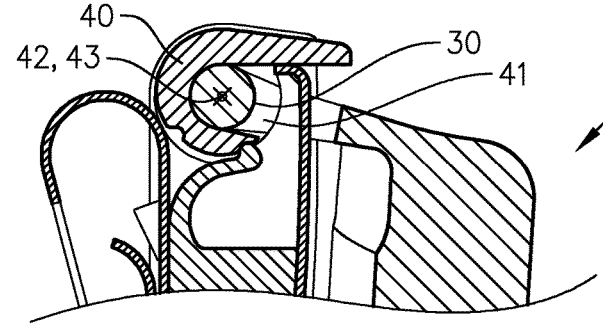

FIG. 12*d* shows the lid 40 of the belt clip closed, forming chamber 41 enclosing the first attachment portion 30. The first axis 42 of the attachment portion and the second axis 43 of the chamber 41 essentially coincide.

FIGS. 12*e*-12*h* shows a cross sectional view of a second example of the tool bit holder 10 and the belt clip 36.

In the second example the lid 40 is arranged to be closed by means of a spring 54 attached at one end of the lid 40. The spring is preferably a torsion spring and is biased towards closing the lid 40. Attachment of the spring 54 to the lid 40 and to the belt clip 36 can be made in a number of ways known in the art. A second spring 54 can also be arranged at the opposite end of the lid 40 increasing the power exerted on the lid to close it.

Figure 12E:
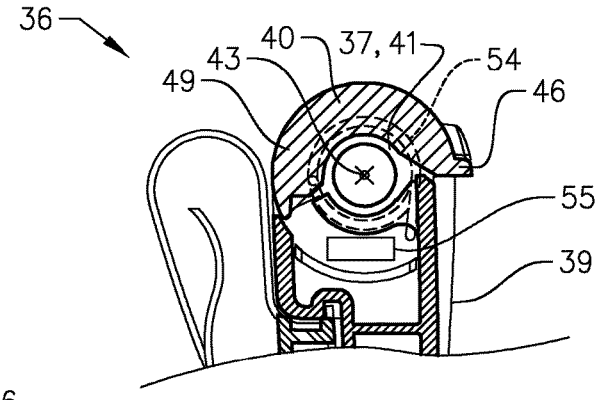

FIG. 12*e* shows the lid in a closed position. Chamber 41 is formed by the compartment 37 and the lid 40 closing over the compartment 37. The second axis 43 of the chamber 41 is seen to be essentially coaxial with the rotational axis of the lid 40 which is the rotational axis of the hinge 49.

Figure 12F:
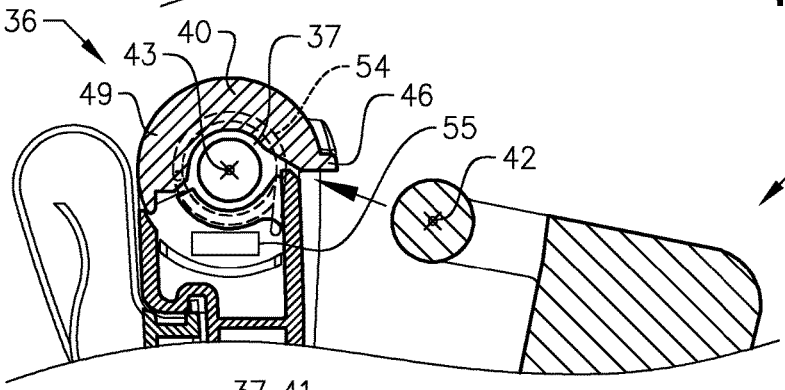

FIG. 12*f* shows the tool bit holder 10 being inserted into the compartment. The lid 40 is opened by pushing the first attachment portion 30 into the compartment opening 44. The first attachment portion has a slightly larger cross section than the height of the compartment opening, thereby forcing the lid 40 to open. The first attachment portion 30 is thereafter inserted into the compartment 37.

The lid 40 can alternatively be pushed open either by the hand of a user or by sliding the attachment portion upward along the front side of the belt clip 36. When the attachment portion 30 reaches the lip 46 the lid 40 is pushed open and the attachment portion can be inserted into the belt clip 36. In FIG. 12*f* the lid 40 is schematically shown in an open position.

Figure 12G:
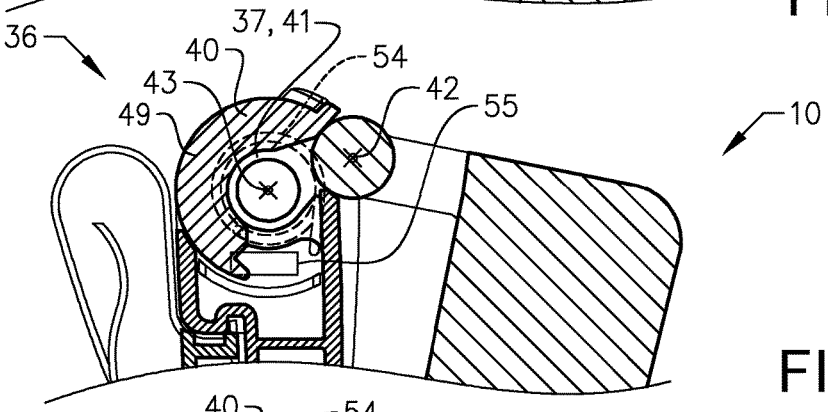

FIG. 12*g* shows the first attachment portion 30 inserted into the compartment 37. The first axis 42 of the first attachment portion 30 is as seen from the figure essentially coaxial with the rotational axis of the hinge 49 and of the second axis 43 of the compartment 37.

Figure 12H:
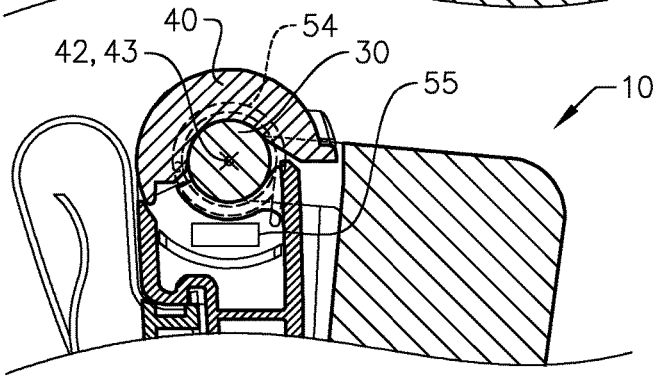

FIG. 12*h* shows the lid 40 of the belt clip completely closed, forming chamber 41 enclosing the first attachment portion 30. The first axis 42 of the attachment portion and the second axis 43 of the chamber 41 essentially coincide.

In FIGS. 12*e*-*h* a clip magnet 55 is shown placed beneath the lid 40. The clip magnet 55 is arranged to interact with the attachment end portion 30*a*, 30*b* of the first attachment portion 30 of the tool bit holder to ensure that the tool bit holder is kept in a more firm position in the chamber 41. The use of the magnets ensures that the first attachment portion remains still within the chamber 41 if the attachment portion 30 is slightly smaller than the chamber 41.

The spring 54 and the flexible arm 51, the first groove and second groove can be incorporated into the same belt clip.

Figure 13A:
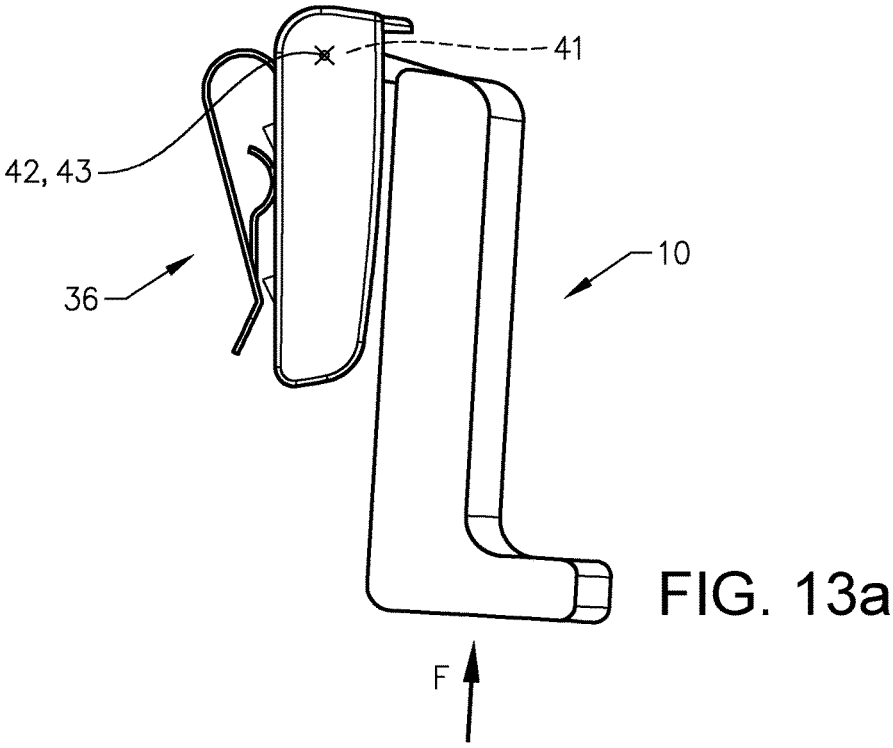
FIGS. 13*a*-13*c* show the function of the holder arrangement according to the invention.
Figure 13B:
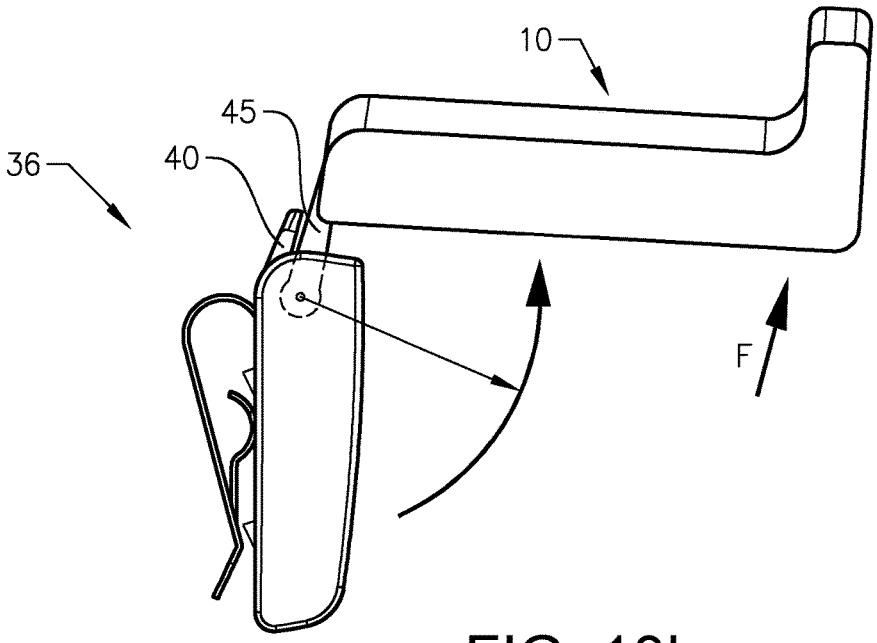
Figure 13C:
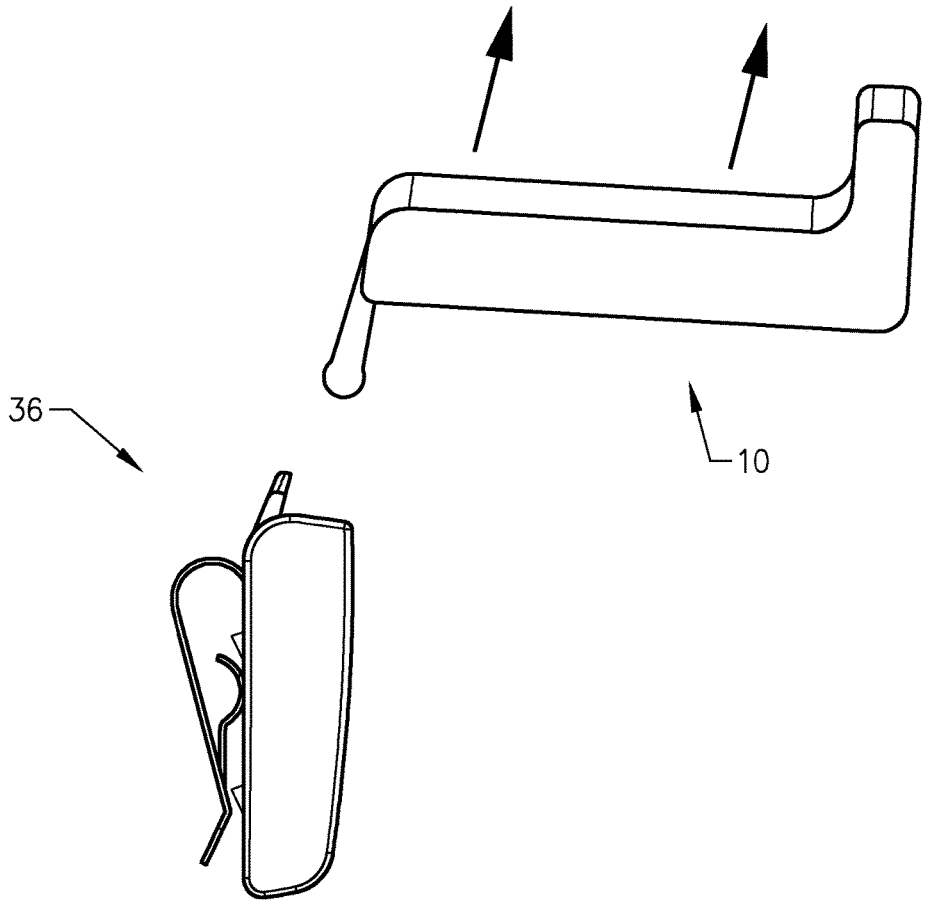

FIGS. 13*a*-13*c* show the function of the arrangement according to the invention.

FIG. 13*a* shows the tool bit holder 10 inserted into the belt clip 36. A linear force F is exerted upwards on the tool bit holder from below. As explained above the coaxiality of the first and second axes 42, 43 prevents any force to be transferred from the first attachment portion 30 to the lid such that a torque acts on the lid. The tool bit holder stays in the chamber 41.

FIG. 13*b* show the tool bit holder experiencing a force directed upwards/forwards causing the tool bit holder 10 to rotate forwards/upwards. The rotation of the tool bit holder 10 causes the second attachment portions 45 to exert a force on lid 40, pushing upward on the lid 40. The lid 40 starts to rotate open.

FIG. 13*c* show the tool bit holder 10 separated from the belt clip 36.

The above arrangement ensures that the lid 40 of the belt clip 36 cannot be opened by pushing on the attachment portion and to that the hinged lid 40 is openable only by rotating the lid 40 itself or by rotating the entire attachment means 29. When rotating the tool bit holder 10 the second attachment portions 45 exert a force on the lid 40, causing the lid 40 to rotate open.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. Accordingly, the drawings and the description thereto are to be regarded as illustrative in nature, and not restrictive.

The invention claimed is:

1. A tool bit holder (10), for holding tool bits for a hand tool, wherein:

the tool bit holder (10) has an extension along an x-axis, along a y-axis being perpendicular to the x-axis, and along a z-axis being perpendicular to the x-axis and y-axis, wherein the tool bit holder (10) comprises an at least partially arc-shaped main surface (12), the arc-shaped part (13) of the main surface (12) at least partially transitions between the y-axis to the z-axis, the main surface (12) is provided with an elongated slit (11) extending at least along its arc-shaped part (13) essentially along the x- and y-axis, the slit (11) is provided with an inner and an outer section (16, 17), the outer section (17) is level with the main surface (12) and the inner section (16) is wider than the outer section (17), whereby the outer section (17) is adapted to receive a waist (3) of a tool bit (1) according the standard ISO 1173:2001, Form E, the main surface (12) comprises a front part (14) having an extension essentially in the x-y-plane transitioning to a bottom part (15) extending essentially in the x-z-plane, the transition between the front part (14) and the bottom part (15) comprises the arch-shaped part, and the slit (11) extends downwards along the y-axis past the arc-shaped part (13) and comprises holding means for securing the bit in the tool bit holder.

2. The tool bit holder (10) according to claim 1, wherein the slit (11) extends downwards along the y-axis past the arc-shaped part (13) and the holding means comprises first and second holding side walls (20, 21) extending essentially in the y-z-plane.

3. The tool bit holder (10) according to claim 2, wherein the tool bit holder (10) comprises a protective cover (23), wherein the cover comprises a first cover part (24) extending essentially in the x-y-plane arranged downwards past the first and second holding side walls (20, 21) of the slit (11) along the y-axis, transitioning to a second cover part (25) extending essentially in a x-z-plane, the first cover part (24) and the second cover part (25) being arranged at an angle relative each other, the angle of the second cover part (25) being between 60° and 120° relative the first cover part (24).

4. The tool bit holder (10) according to claim 1, wherein the slit (11) extends downwards along the y-axis past the arc-shaped part (13) and the holding means comprises a holder magnet (53) which is located on a surface extending downward from a third inner side wall (26).

5. The tool bit holder (10) according to claim 4, wherein the inner section (16) of the slit (11) comprises the third inner side wall (26) extending essentially in the x-y-plane.

6. The tool bit holder (10) according to claim 4, wherein the tool bit holder (10) comprises a multitude of slits (11), wherein the distance between a centre line of two adjacent slits (11) is less than or equal to 30 mm.

7. The tool bit holder (10) according to any one of claim 1, where the outer section (17) of the slit (11) is formed by that the arc-shaped part (13) of the main surface (12) extend past the inner section (16) on either side of the slit (11).

8. The tool bit holder (10) according to claim 7, wherein the inner section (16) of the slit (11) comprises a first inner side wall (18) and a second inner side wall (19) opposite the first inner side wall (18), the first and second inner side walls (18, 19) extending essentially in the y-z-plane, the first and second inner side walls (18, 19) extending from the arc-shaped part (13) of the main surface (12) along the z-axis, the distance between the first and second side wall being greater than the width of the outer section (17) of the slit (11).

9. The tool bit holder (10) according to claim 1, wherein the arc-shaped part (13) subtends an angle between 80° and 100°, and wherein the radius of the arc-shaped part (13) is between 6 mm and 10 mm.

10. The tool bit holder (10) according to claim 1, wherein the width of the outer section (17) is between 4.7 mm and 7.18 mm, specifically between 4.7 mm and 6.35 mm, such that the outer section (17) of the slit (11) is adapted to receive the waist (3) of a tool bit (1) according to the standard ISO 1173:2001, Form E-6,3.

11. The tool bit holder (10) according to claim 1, wherein the tool bit holder (10) comprises a row (32) of slots (31) for storing drive bits, the row (32) of slots (31) being placed on top of the tool bit holder (10) along the x-direction covering the slits (11).

12. The tool bit holder (10) according to claim 1, wherein the tool bit holder comprises an attachment portion (30) of the tool bit holder (10) which comprises at least one attachment portion end (30*a*, 30*b*) comprising a metallic cladding covering at least a part of the outer surface of the attachment portion end (30*a*; 30*b*) or comprising a metallic part constituting at least part of the cross section of the attachment portion end (30*a*; 30*b*).

13. A holder arrangement comprising a tool bit holder (10) for holding tool bits for a hand tool and a belt clip (36), wherein:

the tool bit holder (10) has an extension along an x-axis, along a y-axis being perpendicular to the x-axis, and along a z-axis being perpendicular to the x-axis and y-axis, wherein the tool bit holder (10) comprises an at least partially arc-shaped main surface (12), the arc-shaped part (13) of the main surface (12) at least partially transitions between the y-axis to the z-axis, the main surface (12) is provided with an elongated slit (11) extending at least along its arc-shaped part (13) essentially along the x- and y-axis, the slit (11) is provided with an inner and an outer section (16, 17), the outer section (17) is level with the main surface (12) and the inner section (16) is wider than the outer section (17), whereby the outer section (17) is adapted to receive a waist (3) of a tool bit (1) according the standard ISO 1173:2001, Form E, the main surface (12) comprises a front part (14) having an extension essentially in the x-y-plane transitioning to a bottom part (15) extending essentially in the x-z-plane, the transition between the front part (14) and the bottom part (15) comprises the arch-shaped part, the slit (11) extends downwards along the y-axis past the arc-shaped part (13) and comprises holding means for securing the bit in the tool bit holder, the tool bit holder (10) further comprises an attachment means (29) comprising a first attachment portion (30) extending essentially along the x-axis having an essentially circular cross section in the y-z-plane, the attachment means (29) being attached to a rear surface of the tool bit holder (10) opposite the front part (14) of the main surface (12) of the tool bit holder (10), and the belt clip (36) comprises a compartment (37) arranged at a first end (38) of the belt clip (36), the compartment (37) being covered by a rotatable hinged lid (40), wherein the compartment (37) extends across the belt clip (36) between a first and second end of the lid (40); the compartment (37) and the lid (40), when the lid (40) is closed over the compartment (37), form a chamber (41) having an essentially circular cross section; wherein a first axis (42) of the first attachment portion (30) when inserted into the chamber (41), and a second axis (43) of the chamber (41) is essentially coaxial.

14. The holder arrangement according to claim 13, wherein the attachment portion (30) of the tool bit holder (10) comprises at least one attachment portion end (30*a*, 30*b*) comprising a metallic cladding covering at least a part of the outer surface of the attachment portion end (30*a*; 30*b*) or comprising a metallic part constituting at least part of the cross section of the attachment portion end (30*a*; 30*b*) and the belt clip comprises at least one magnet (55) arranged to interact with the at least one attachment portion end (30*a*, 30*b*) of the attachment portion (30) when the tool bit holder (10) is inserted into the belt clip (36).

* * * * *